US008292540B2

(12) United States Patent
Pickavance et al.

(10) Patent No.: US 8,292,540 B2
(45) Date of Patent: Oct. 23, 2012

(54) MANHOLE ASSEMBLY AND RELATED METHOD

(75) Inventors: John Neil Pickavance, Bingham (GB); Jean-Claude Royer, Lesmenils (FR); Alan Jack Pendleton, Melton Mowbray (GB)

(73) Assignee: Saint-Gobain Pam, Nancy (FR)

( * ) Notice: Subject to any disclaimer, the term of this patent is extended or adjusted under 35 U.S.C. 154(b) by 1057 days.

(21) Appl. No.: 11/813,147

(22) PCT Filed: Dec. 29, 2005

(86) PCT No.: PCT/GB2005/005086

§ 371 (c)(1),
(2), (4) Date: Jan. 22, 2008

(87) PCT Pub. No.: WO2006/070191

PCT Pub. Date: Jul. 6, 2006

(65) Prior Publication Data

US 2011/0150570 A1 Jun. 23, 2011

(30) Foreign Application Priority Data

Dec. 29, 2004 (GB) ..... 0428410.5

(51) Int. Cl.
*E02D 29/14* (2006.01)

(52) U.S. Cl. ..... 404/25; 137/371

(58) Field of Classification Search ..... 404/25, 404/26; 137/371; 52/19
See application file for complete search history.

(56) References Cited

U.S. PATENT DOCUMENTS

| | | | | |
|---|---|---|---|---|
| 284,170 | A * | 9/1883 | Bosworth | 404/22 |
| 2,997,932 | A * | 8/1961 | Taylor | 404/26 |
| 3,501,874 | A * | 3/1970 | Hahne | 52/20 |
| 4,508,469 | A | 4/1985 | Dumortier | |
| 4,535,908 | A * | 8/1985 | Dabich | 220/484 |
| 6,357,962 | B1 * | 3/2002 | Pate | 404/25 |
| 6,616,371 | B2 * | 9/2003 | Pate | 404/25 |

(Continued)

FOREIGN PATENT DOCUMENTS

| | | |
|---|---|---|
| EP | 0 808 951 | 11/1997 |
| GB | 2 262 557 A | 6/1993 |
| GB | 2 348 665 | 10/2000 |

(Continued)

OTHER PUBLICATIONS

U.S. Appl. No. 11/722,013, filed Jun. 18, 2007, Pendleton, et al.

*Primary Examiner* — Gary S Hartmann
(74) *Attorney, Agent, or Firm* — Oblon, Spivak, McClelland, Maier & Neustad, L.L.P.

(57) ABSTRACT

A manhole assembly including a frame and at least a pair of cover plates that are receivable in and disengageable from the frame to permit selective closing and opening of an aperture, the periphery of which is defined by the frame. The cover plates substantially occupy the aperture when received in the frame. A first cover plate of a pair thereof is smaller than a second cover plate of the pair. The first cover plate is hingeable relative to the second cover plate, while the latter is received in the frame, from a closed position received in the frame to an open position in which a first part of the aperture is open. The second cover plate is removable from the frame, when the first cover plate is disengaged from the frame, to open a second part of the aperture.

26 Claims, 19 Drawing Sheets

U.S. PATENT DOCUMENTS

| | | | | |
|---|---|---|---|---|
| 7,866,915 | B2 * | 1/2011 | Pendleton et al. | 404/25 |
| 2007/0154259 | A1 | 7/2007 | Pendleton et al. | |
| 2011/0150570 | A1 * | 6/2011 | Pickavance et al. | 404/25 |
| 2012/0020729 | A1 * | 1/2012 | Royer et al. | 404/25 |

FOREIGN PATENT DOCUMENTS

| | | |
|---|---|---|
| GB | 2 359 319 | 8/2001 |
| GB | 2 388 863 | 11/2003 |
| JP | 5-280066 | 10/1993 |

* cited by examiner

MANHOLE ASSEMBLY AND RELATED METHOD

This invention relates to a manhole assembly.

BACKGROUND

A typical manhole assembly comprises a frame including an upstanding wall having protruding outwardly therefrom a peripheral flange. The flange usually extends from the lowermost edge of the wall and on installation of the manhole assembly is buried in a bedding medium such as mortar in order to secure the frame over au aperture such as the entrance to an inspection chamber or drain. Thus the upstanding wall in practice defines the boundary of the aperture, which boundary is in most cases rectangular although in some cases it is circular.

It has been found to be particularly convenient to use triangular cover plates, that are receivable on seatings forming part of the upstanding wall, in order to close a rectangular aperture of the aforesaid type.

The cover plates typically are removable from their position closing off the aperture.

The rectangular frames usually are either in a form defining a substantially square aperture; or in a form deeming an elongate, rectangular aperture.

In the former case a single pair of triangular cover plates is sufficient to close off the aperture. In the latter case typically two pairs of the cover plates are used.

The only way of occupying a generally square aperture through the use of two triangular cover plates is to employ right-angled triangular shapes for the plates. Such shapes are also suitable for use in sets of pairs for closing off the elongate rectangular apertures described hereinabove. Triangular plates are particularly appropriate since they readily lend themselves to being supported on their undersides at three locations corresponding approximately to the apices of the triangular shapes. This renders the cover plates largely non-rocking, and hence generally silent in use, even when for example road traffic has caused substantial wear of the seatings on which the apices of the triangular cover plates rest.

Despite these well-established advantages of triangular cover plates, several problems remain.

One of these derives from the mass of the cover plates.

Typically the plates are cast from iron. Consequently they weigh several tens of kilograms. A worker attempting to lift a cover plate free of the aperture defined by the manhole frame may consequently suffer strain injuries, especially if his lifting technique is defective; or impact injuries caused by incorrect handling (ie. dropping etc) of the plates.

Partly in response to this problem, there have been numerous proposals for hingedly securing the triangular cover plates to the upstanding wall of the frame.

This provides a partial solution to the problem of potential injury, since firstly the worker does not have to lift the entire cover plate mass (some of which is supported by the hinges); and secondly there is a reduced, but not entirely eliminated, chance of dropping a cover plate so as to cause injury.

However, several disadvantages of hingedly secured cover plates have become apparent.

One of these derives from the manner in which a worker typically opens the cover plates.

Each triangular cover plate is hingedly secured along a single, non-hypotenuse side, to the frame. Thus a given pair of the cover plates are juxtaposed along their respective hypotenuses when closed in order to cap the aperture.

A worker wishing to open such a cooper plate typically, would stand outside the frame with his feet adjacent such a non-hypotenuse side. He would then lean forwardly for the purpose of inserting a lifting tool into an aperture formed adjacent the apex of the cover plate furthest from him.

A commonly used lifting tool includes a gripping handle by means of which, following its insertion into the aperture, the worker is able to draw the cover plate in an upwardly extending arc utilising the hinges.

Necessarily this action involves the worker in stretching forwardly in order firstly to insert the lifting tool and secondly to draw the cover plate upwardly.

Physiotherapists and ergonomists have for long recognised that lifting in the resulting semi-squatting position can, for some users, cause difficulties. Therefore it would be desirable to eliminate this mode of lifting of cover plates.

Furthermore, cover plates that are hingedly secured to the manhole frames typically include hinges that are releasable when the cover plates are in their open positions.

This allows the complete removal of each cover plate from the frame.

However, lifting of the cover plates from their open positions clear of the frame may be a sub-optimal lifting method since the worker may attempt to grip the cover plate adjacent its free apex. The tapering form presented at this location may be difficult to grip, thereby increasing the difficulty of lifting.

In addition to the foregoing, the known pairs of right-angled triangular cover plates are of equal sizes. If one of them is removed from the frame as aforesaid, it becomes possible on attempting to remove the second of them to drop the second cover into the aperture bounded by the frame, with potentially troublesome results.

Even if this does not happen the step of opening one of a pair of generally identical triangular cover plates results in opening of 50% of the aperture area that they cover when closed. The resulting opening may be large enough to allow eg. tools to fall into the aperture.

SUMMARY

Thus it would be desirable to provide a manhole assembly manipulation of the covers of which obviates one or more of the above-mentioned disadvantages of the prior art arrangements.

According to a first aspect of the invention there is provided a manhole assembly comprising a frame and at least a pair of cover plates that are receivable in and disengageable from the frame to permit selective closing and opening of an aperture the periphery of which is defined by the frame, the cover plates substantially occupying the aperture when received in the frame; a first cover plate of a said pair being smaller than a second cover plate of the pair; the first cover plate being hingeable relative to the second cover plate, while the latter is received in the frame, from a closed position received in the frame to an open position in which a first part of the aperture is open; and the second cover plate being removable from the frame, when the first cover plate is disengaged from the frame, to open a second part of the aperture.

This arrangement solves several of the problems noted in relation to the prior art arrangements.

In particular, it encourages a worker who wishes to open a manhole initially to stand on the second cover plate of the pair, from which location he may open the first cover plate by hinging it relative to the second one.

Proceeding in this fashion provides numerous benefits.

Firstly the first cover plate is the lighter of the pair. The worker therefore does not need to lift a heavy plate merely for the purpose of completing a visual inspection of the interior of the aperture. On the contrary, he needs to lift the (heavier) second cover plate only in the event of the visual inspection made possible by lifting the first cover plate indicating a need to gain access to the interior of the chamber or other feature with which the aperture communicates.

Secondly, by standing on the second cover plate (as contrasted with a location outside the frame) the worker minimises the extent to which he must lean forwardly or stretch in order to open the first cover plate. This in turn minimises the risk of injury.

Thirdly the use of unequally sized cover plates allows the opening of only a comparatively small part of the aperture for the purpose of inspecting its interior, such that the risk of dropping tools, cover plates and other items into the interior is significantly reduced.

Although in the preferred embodiment of the invention, described in detail herein, the difference in the size of the first and second cover plates is evident from their appearance when viewed in plan, this need not necessarily be so. On the contrary the plan views of the cover plates of the pair may if desired be exactly or substantially identical, with the difference in size being the result of features that are not visible when the cover plates are in use to close an aperture.

Examples of such features include different numbers or sizes of ribs formed on the undersides of the plates; or even simply the manufacture of the plates from materials of differing densities.

When thus configured, ie. so that the unequally sized cover plates each occupy the same area of the aperture, of course the advantage of providing a comparatively small inspection opening would not arise. Nonetheless such an embodiment is advantageous not least because even if the inspection opening occupies (for example) half the area of the aperture its cover plate would be easier to lift than the other cover plate of a pair, by reason of the lightness of the former relative to the latter.

Preferably the first and second cover plates of each pair in plan view are generally of right-angled triangular shape, and in particular isosceles triangular shape.

Also conveniently in use of the assembly the hypotenuses of the triangular shapes are mutually juxtaposed along a line.

These features, that are known per se in the manhole assembly art, allow the cover plates efficiently to close off the aperture defined by the frame, using a minimum amount of material in the cover plates.

It is also preferable that the apices of the triangular shapes are truncated.

This feature is also known per se. It is advantageous because, firstly, a sharply pointed corner is as a result of its narrowness more susceptible to damage and/or breakage than a truncated apex.

Secondly a sharply pointed corner is a potential safety hazard if the cover is propped in an upright position.

In accordance with the above-mentioned features, the upstanding wall of the frame, which wall defines a recess for receiving the cover plates, is truncated at locations corresponding to the truncated apices of the triangular plates when the latter are received in the frame.

Consequently the upstanding wall of the frame is of substantially the same shape and only very slightly larger than the shape defined by the cover plates when viewed in plan while received in the frame. As a result the cover plates close off the aperture in an efficient manner while providing the per se known benefits of truncated cover plate apices.

In more detail, the upstanding wall preferably intersects each end of the line along which the hypotenuses of the triangular shapes are juxtaposed; and the upstanding wall includes at at least one said intersection with the said line a stepped portion that accommodates the differing lengths of the hypotenuses of the respective cover plates.

This feature further assists in accommodating the shape defined by the cover plates when juxtaposed along their hypotenuses.

Preferably the manhole assembly includes one or more hinges interconnecting the first and second cover plates of the pair so as to permit movement of the first cover plate relative to the second cover plate from the first orientation relative thereto via a second orientation to a third orientation relative thereto.

This feature contrasts advantageously with the arrangements of the prior art, in which typically the cover plates both are hingedly secured to the frame of the manhole assembly.

Preferably the or each hinge includes a tongue that is receivable an opening in an open-sided pocket, the tongue and the pocket being so formed as to permit:

a. rotatable retention of the tongue relative to the pocket when the first cover plate occupies at least the first orientation relative to the second cover plate; and
b. separation of the first cover plate from the second cover plate when the first cover plate occupies the second orientation relative to the second cover plate.

Preferably the first orientation corresponds to the relative orientation of the cover plates when both are received in the frame.

The foregoing features advantageously provide a number of options with regard to removal of the cover plates from the aperture.

Thus, for example, it is possible firstly to open the first cover plate, by hinging it relative to the second cover plate for the purpose of inspecting the interior of the aperture.

Secondly it is possible completely to separate the first cover plate from the second cover plate should this be desired.

The first and second cover plates each preferably include a structure that permits lifting of the respective cover plate. One possibility is for the structure to be constituted as a lifting aperture of per se known design.

In another embodiment of the invention the lifting structure of at least the first cover plate is formed in an end wall of the cover plate so as to be obscured when the first cover plate is received in the frame.

Conveniently the tongue and the pocket are so formed as to cause retention of the first cover plate relative to the second cover plate when the first cover plate occupies the third orientation relative to the second cover plate.

This feature permits eg. propping of the first cover plate in an open position.

Preferably the first and third orientations of the first cover plate relative to the second cover plate correspond to extremes of movement of the first cover plate relative to the second cover plate when the latter is received in the frame; and the second orientation corresponds to a position of the first cover plate, relative to the second cover plate, that is intermediate the extremes.

Even more specifically the tongue and the pocket each preferably include a protuberance, the said protuberances being mutually engageable when the first cover plate occupies the third orientation relative to the second cover plate so as to prevent removal of the tongue via the open side of the pocket and hence retain the first cover plate relative to the second cover plate.

The nature of the mutual engagement of the protuberances facilitates the aforementioned propping of the first cover plate in an open position.

It is also preferable that the or each said pocket includes formed therein a recess, into which at least part of the tongue passes during movement of the first cover plate between the first and third orientations thereof relative to the second cover plate, the recess providing clearance for the tongue during such movement of the first cover plate.

In a particularly preferred embodiment of the invention the manhole assembly includes a lock for releasably locking the first cover plate in the first orientation relative to the second cover plate.

Although locks per se for the cover plates of manhole assemblies are known, hitherto there has been no proposal to employ such locks in combination with the other features of the invention defined hereinabove.

Furthermore, preferably the lock comprises a locking tongue secured on the in-use underside of the first cover plate; and a tab, with which the locking tongue is engageable, that lies on the frame and is obscured by the first cover plate when the latter is received in the frame, at least one of the locking tongue and the tab being resiliently deformably mounted and the locking tongue and the tab being so located as releasably to engage one another the when the first cover plate is received in the frame.

As a result of this arrangement it is necessary to lock only the first cover plate to the frame, since the nature of the interconnection between the first and second cover plates means that such locking automatically also retains the second cover plate securely in the frame. Thus the locking of both the cover plates is achieved efficiently. Furthermore, unlocking of the cover plates is equally as efficient since it is necessary to release only the first cover plate in order subsequently to permit removal of the second cover plate from the frame.

In an alternative locking arrangement, the lock includes a locking tongue secured on the in-use underside of the first cover plate; and a tab, with which the locking tongue is engageable, that lies on the second cover plate and is obscured by the first cover plate when the latter is received in the frame, at least one of the locking tongue and the tab being resiliently deformably mounted and the locking tongue and the tab being so located as releasable to engage one another when the first cover plate is received in the frame.

In this arrangement locking of the first cover plate in position in the frame may be achieved very readily since in practice it is necessary for a worker only to stamp the first cover plate downwardly relative to the second one in order to achieve securing of both the cover plates in the frame. Releasing of the first cover plate is also straightforward in accordance with principles defined hereinbelow.

Moreover this arrangement permits coupling of the cover plates together, whereby the pair of cover plates are removable, together, from the frame to permit rapid opening of the entire area otherwise closed off by the cover plates.

When the cover plates are removed in this manner of course it is not a prerequisite that the first cover plate is disengaged from the frame before lifting of the second one. On the contrary, removal of both the cover plates would occur generally simultaneously.

The plates can be reinstalled in a reversal of the aforesaid procedure.

Such modes of removal and insertion of the cover plates lie within the scope of the invention as claimed herein. In other words, use of the invention as claimed herein does not exclude a technique of simultaneously lifting both the cover plates out of or into the frame.

Regardless of the precise type of locking arrangement chosen, the locking tongue and/or the tab preferably include mutually engageable surfaces that are, in use of the assembly, inclined relative to the vertical whereby on movement of the first cover plate towards its first orientation relative to the second cover plate the surfaces displace the locking tongue and/or the tab against the resilience of its mounting; and the locking tongue and the tab preferably include locking surfaces that are engageable one with the other, following such displacement, to inhibit release of the locking tongue and the tab one from the other.

Also regardless of the precise arrangement of the locking components adopted, the frame and/or the first cover plate preferably include formed therein one or more apertures or recesses for receiving a tool for prising the first cover plate from the frame against the resilience of the mounting of the locking tongue and/or the tab.

This arrangement advantageously simplifies the unlocking steps since it is necessary merely to insert one or two prising bars into the apertures or recesses so as to act against the resilient mounting of the locking components in order to free the engaging surfaces thereof one from the other.

In preferred embodiments of the invention there is provided a manhole assembly in which one cover plate includes formed therein a lifting recess; and the other cover plate of which includes protruding therefrom a blanking member that closes off the lifting recess, so as to inhibit insertion of a lifting tool thereinto, when the first cover plate occupies its closed position while the second cover plate is received in the frame.

Conveniently the lifting recess is is a through-going aperture that is elongate when viewed in plan. Moreover the lifting recess optionally is formed in the second cover plate of the pair; and the blanking member protrudes from the first cover plate of the pair.

The foregoing features advantageously enhance the security of a manhole assembly according to the invention, especially when the means for securing (typically) the first cover plate of the pair are not immediately apparent to an observer. In that case the only obvious means for removing either cover plate would be the lifting recess; but this is closed off by the blanking plate, when the cover plates are received in the frame, in such a way as to discourage at least an indolent unauthorised user from seeking to open the manhole.

According to a second aspect of the invention there is provided a method of manufacturing a manhole assembly as defined hereinabove including the step of simultaneously casting the cover plates and the frame in a single moulding box, with the first cover plate being cast within the periphery of the frame.

This method is possible because the first cover plate is of noticeably smaller overall dimensions when viewed in plan than the aperture defined by the frame.

The ability to cast the three primary components of the manhole assembly in a single moulding box confers very great advantages in terms of manufacture of the assembly. This is not least because all three components are available, simultaneously, for assembly together to create the article of the invention. This is in contrast with the arrangement of the prior art in which, typically, batches of frames are produced separately from batches of (mutually identical) cover plates.

In the latter case it is necessary to provide storage space for completed frames and/or cover plates pending casting of the remaining components of each assembly.

Consequently, the method of the invention results in significant cost and time savings compared with the prior art techniques.

It is also preferable that the method of the invention includes the steps of, before casting the cover plates and the frame, forming a sand mould in a moulding box.

BRIEF DESCRIPTION OF THE DRAWINGS

There now follows a description of preferred embodiments of the intention, by way of non-limiting example, with reference being made to the accompanying drawings in which.

DETAILED DESCRIPTION

Figure 1:
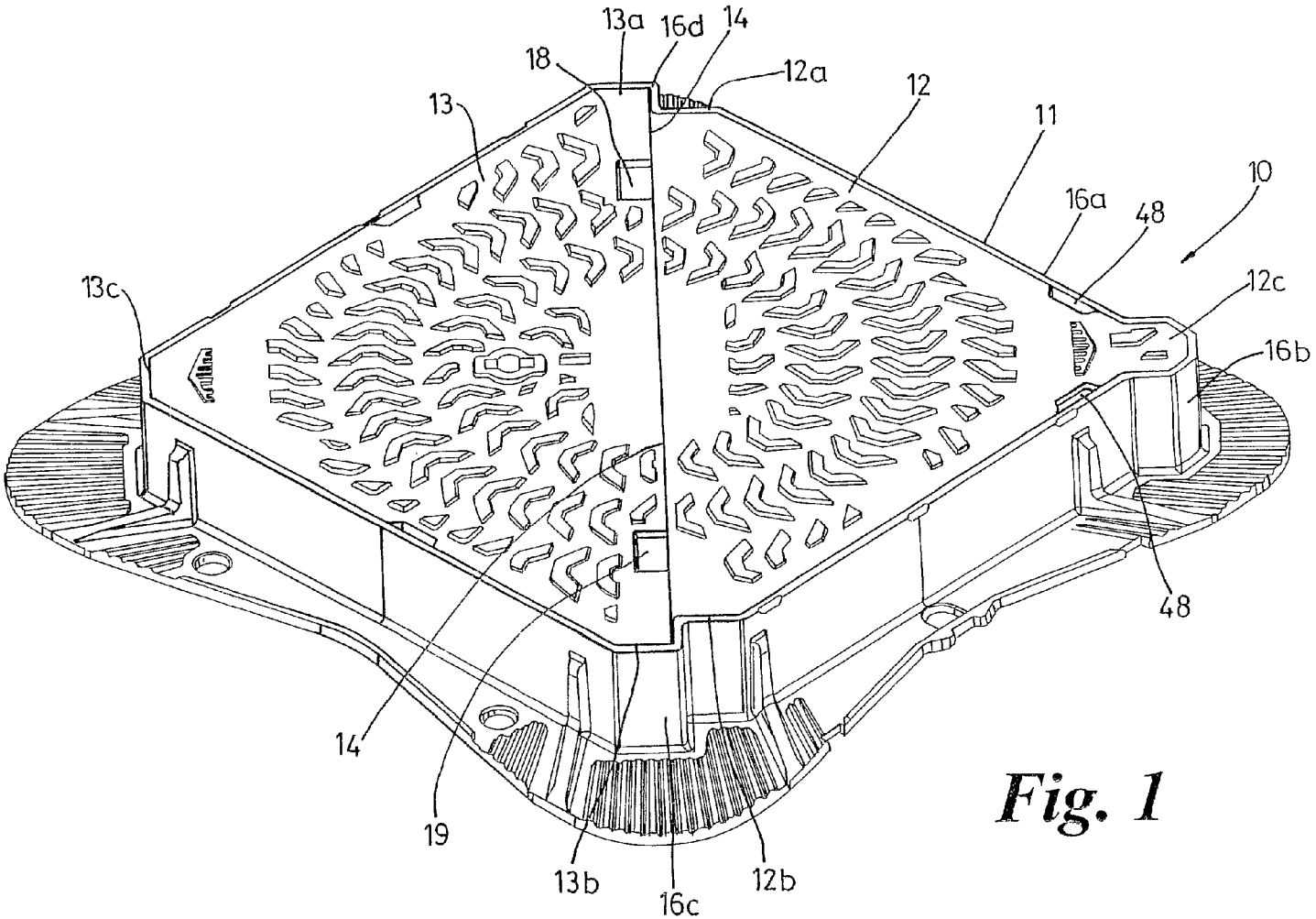
FIG. 1 is a perspective view of a first embodiment of a manhole assembly according to the invention, shown minus a bedding medium that in use would surround the flange and the exterior of the upstanding wall visible in the figure.

Referring to the drawings, a first embodiment 10 of manhole assembly includes a frame 11 that in the embodiment shown defines an approximately square boundary to an aperture such as but not limited to a sub-carriageway drain, inspection chamber or cable duct.

The manhole assembly further includes a pair of cover plates respectively referred to herein as the "first cover plate" 12 and the "second cover plate" 13. The cover plates 12, 13 are receivable in and disengageable from the frame 11 to permit selective closing and opening of the aperture the boundary of which is defined by the frame.

FIG. 1 shows the cover plates 12, 13 when received in the frame, in which configuration they substantially occupy, and close off the aperture.

In accordance with the basic principles of the invention defined herein, the first cover plate 12 of the pair is smaller than the second cover plate 13.

In a manner described in more detail hereinbelow, the first cover plate 12 is hingeable relative to the second cover plate 13 while the latter is received in the frame 11. First cover plate 12 is in this way moveable from a closed position as shown in FIG. 1 to an open position in which the portion of the aperture otherwise covered by the first cover plate 12 is open.

Also in a manner described hereinbelow the second cover plate 13 is removable from the frame when the first cover plate 12 is disengaged therefrom. Such removal of the second cover plate 13 effects opening of a further part of the aperture.

The cover plates 12, 13 are generally of right-angled, isosceles triangular shape.

The hypotenuses of the triangular cover plates 12, 13 are, when the plates are received in the frame 11, mutually juxtaposed along a line 14.

The frame 11 comprises essentially an upstanding wall 16 having protruding outwardly from its base a flange 17.

The upper edge 16*a* of the upstanding wall 16 is the only part of the frame 11 that is in use visible at ground level, the remainder of the upstanding wall 16 and the flange 17 being in use embedded in a medium such as but not limited to mortar.

A preferred feature of the cover plates 12, 13 is that their apices are truncated.

In the case of the second cover plate 13 of the FIG. 1 embodiment each apex 13*a*, 13*b*, 13*c* thereof is simply of the flattened (non-pointed) form shown.

The apices 12*a*, 12*b* of the first cover plate 12 that lie respectively at the ends of the hypotenuse of the triangular shape of first cover plate 12 are flattened in a similar manner to that of the apices 13*a*, 13*b*, 13*c* of second cover plate 13.

The apex 12*c* remote from the hypotenuse of first cover plate 12 as shown includes an extended portion the free end of which is flattened to a non-pointed form.

The upstanding wall 16 of the frame 11 is shaped to accommodate such truncations of the cover plates 12, 13, whereby the wall 16 closely surrounds, with only a very small clearance, the periphery of the cover plates 12, 13 when the latter are received in the frame as shown in FIG. 1.

Thus the wall 16 includes in the vicinity of apex 12*c* of first cover plate 12 a hollow, protruding portion resembling five of the six sides of a hexagonal prism as shown in FIG. 1.

Figure 2:
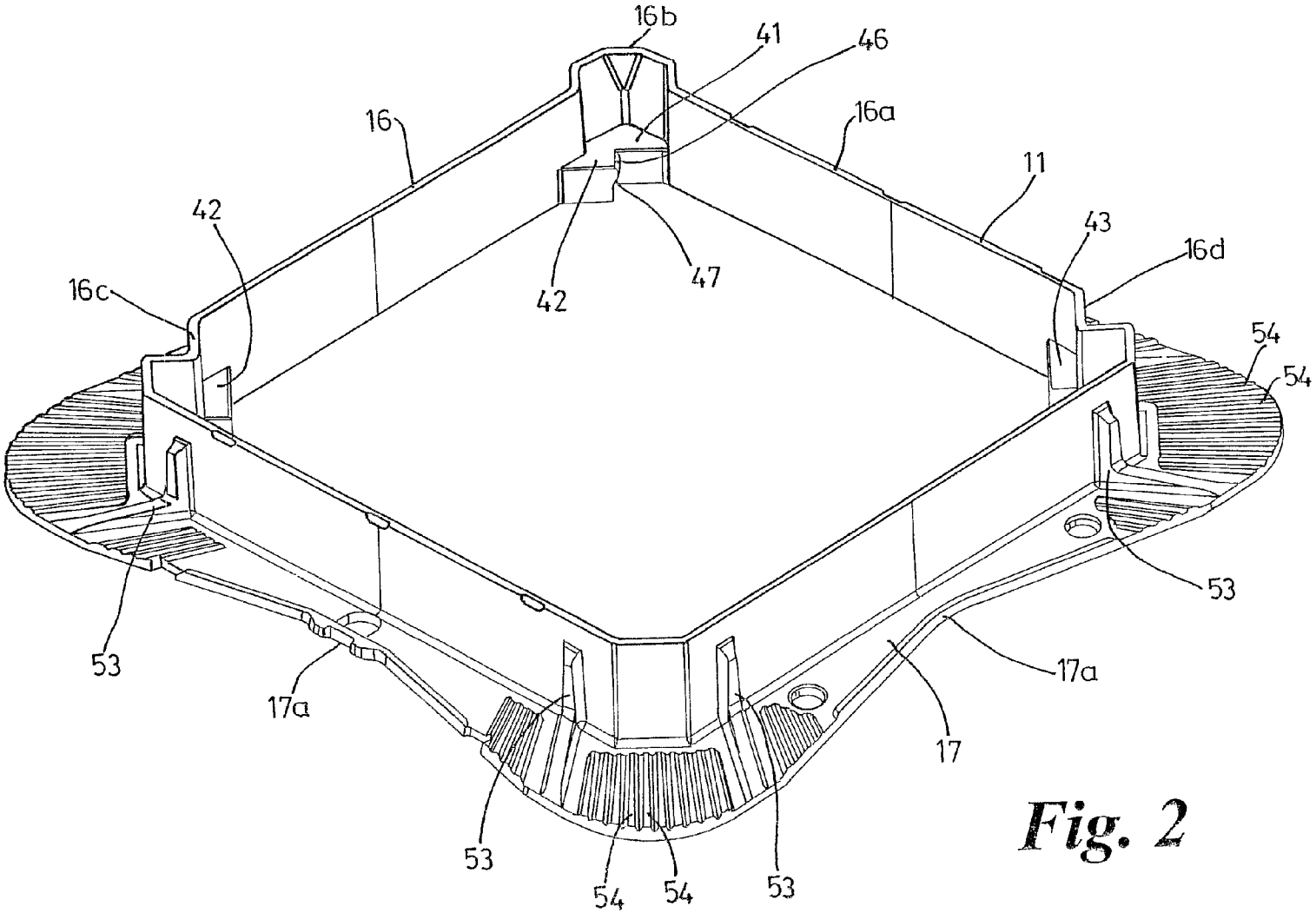
FIG. 2 is a perspective view of the frame of the manhole assembly of FIG. 1, minus its cover plates.
Figure 3:
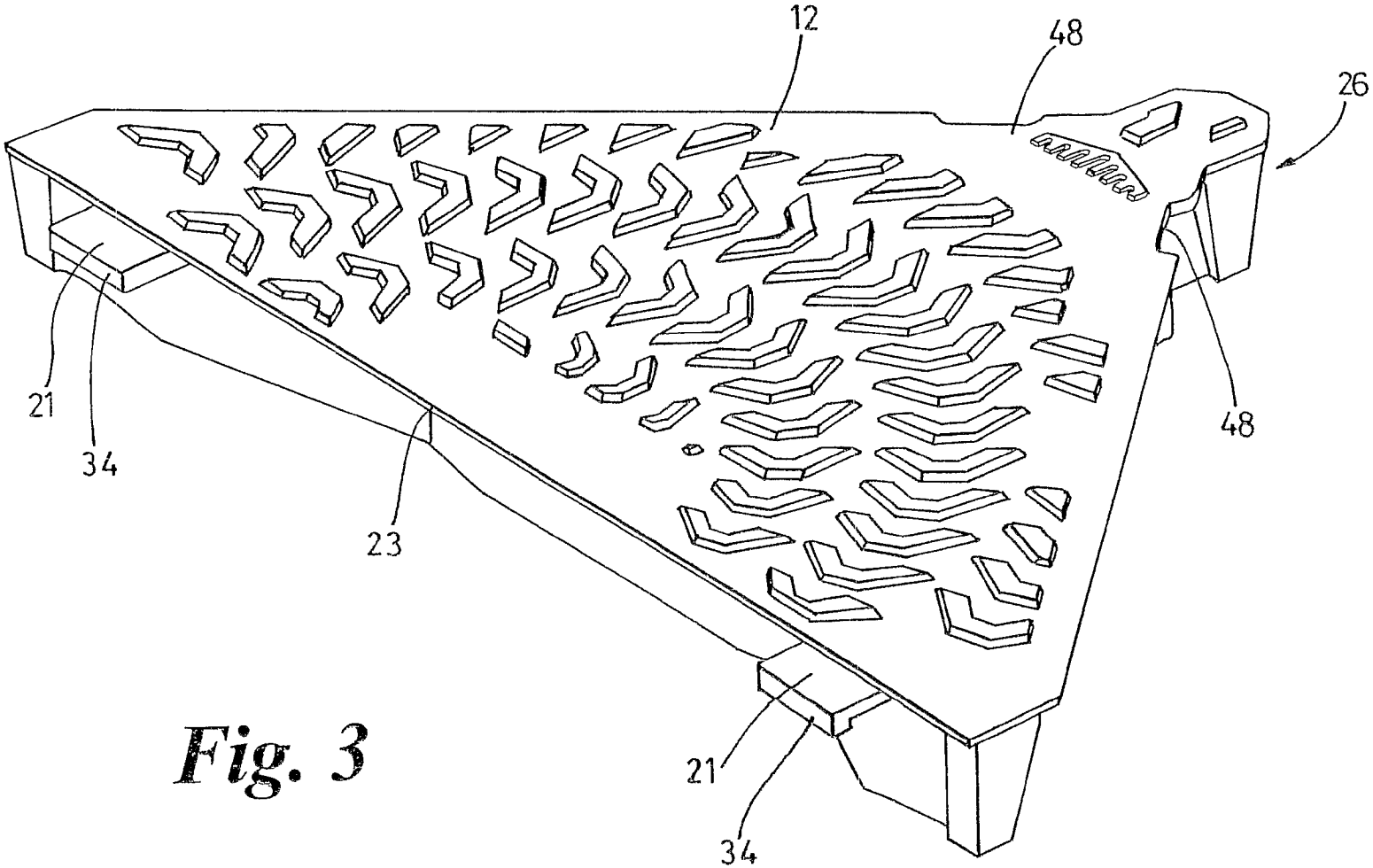
FIG. 3 is a perspective view from above of a first cover plate of the assembly of FIGS. 1 and 2.

The apices 12*a*, 12*b* of the first cover plate 12 are equispaced along juxtaposition line 14 from the respective, adjacent apices 13*a*, 13*b* of second cover plate 13. Thus the periphery of the pair of cover plates 12, 13 is stepped in the vicinity of each pair of apices 12*a*, 13*a* on the one hand and 12*b*, 13*b* on the other. The upstanding wall 16 is similarly stepped at locations 16*c*, 16*d* as shown in FIGS. 1 and 2. This feature readily accommodates in a neat manner the difference in hypotenuse length between the two cover plates 12, 13, without eliminating the right-angled shape of the cover plates.

The manhole assembly of FIGS. 1 to 6 includes a pair of hinges 18, 19 that link the first and second cover plates 12, 13 together when the cover plates are received in the frame 11 as shown.

The hinges 18, 19 lie adjacent the juxtaposition line 14. In the embodiment shown each respective hinge 18, 19 is spaced from the outwardly adjacent apex 13*a*, 13*b* by the same distance. However in other embodiments of the invention not shown in the drawings other numbers and spacings of the hinges are possible.

Regardless of the precise design of the hinges they permit rotational movement of the first cover plate 12 relative to the second cover plate 13 from a first orientation as shown in FIG. 1 via a second orientation to a third orientation relative thereto. In the second and third orientations the first cover plate 12 no longer closes off the portion of the aperture defined by frame 11 that in FIG. 1 lies under the first cover plate 12.

Each hinge 18, 19 includes a respective tongue 21 that is receivable in a respective, open sided pocket 22 formed in the second cover plate 13.

The tongues 21 protrude outwardly of the hypotenuse 23 of the first cover plate 12. The pockets 22 are recessed relative to the hypotenuse 24 of the second cover plate 13.

The shapes of the tongues 21 and pockets 22 are such as to permit separation of the first cover plate 12 from the second cover plate 13 when the first cover plate occupies at least its second orientation (intermediate its first and third orientations) relative to the second cover plate.

Thus the hinges 18, 19 permit rotational movement of the first cover plate 12 from its first orientation received in the frame to an orientation at which the first cover plate 12 may be lifted clear of the second cover plate 13.

To this end, the first cover plate 12 includes a structure that permits lifting thereof away from the frame 11 and the second cover plate 13.

Figure 4:
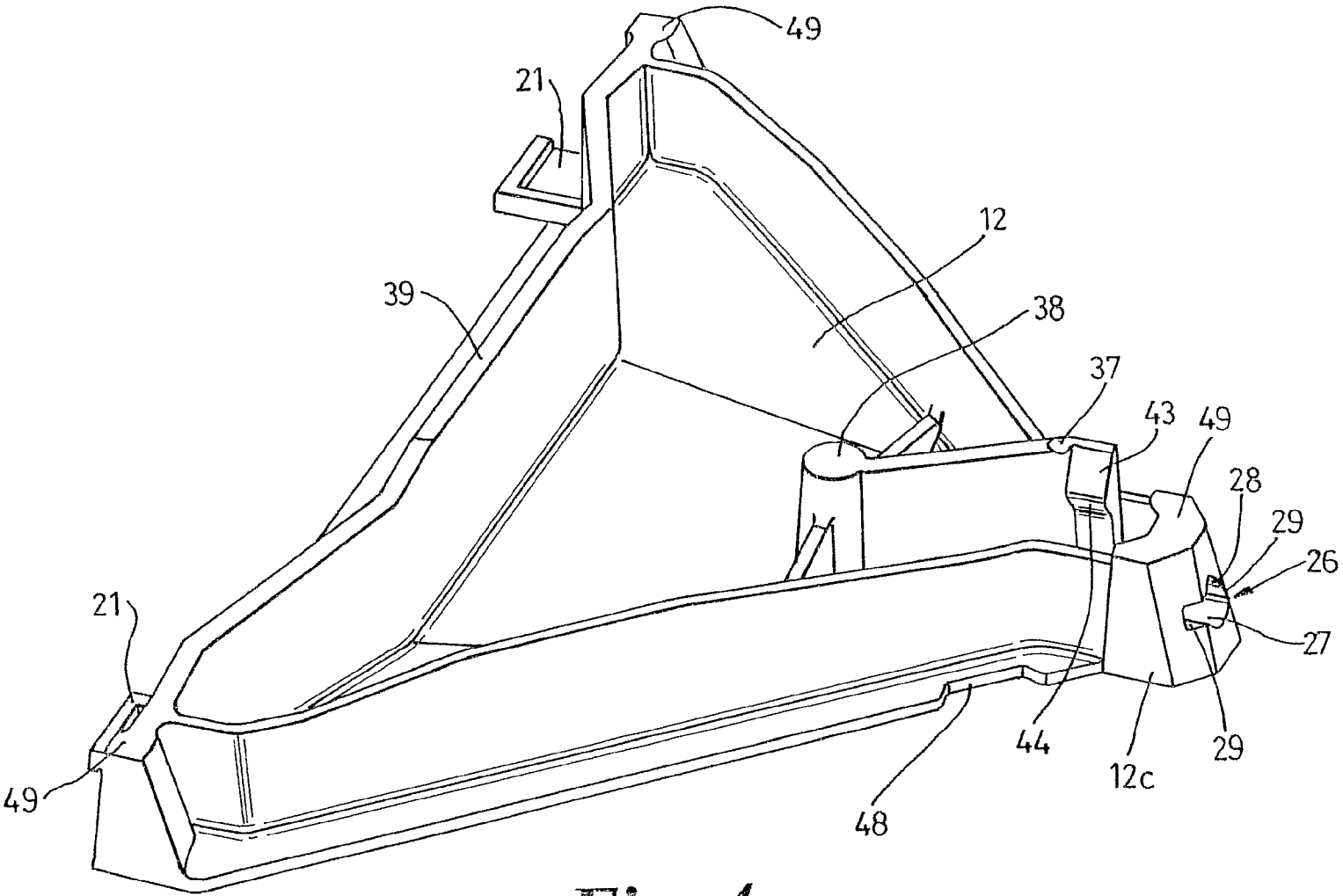
FIG. 4 is a perspective view from underneath of the cover plate of FIG. 3.

As best seen in FIG. 4, in the case of the first embodiment of the invention the lifting structure 26 is embodied as a boss of metal defining the extended region 12*c* of the first cover plate 12.

The lifting structure 26 has formed therein a through-going aperture 27 that extends generally parallel to the in-use upper surface of the first cover plate 12.

The aperture 27 includes a central bore 28 having protruding therefrom on at least one side and in practice both sides respective, parallel sided aperture extensions 29.

These features confer on the lifting structure 26 a shape that is suitable for receiving a per se known cover plate lifting key.

Such a key includes a cylindrical central shaft having protruding on opposite sides thereof respective ears, the shaft and ears being shaped to fit with clearance in to the aperture 27.

The ears extends rearwardly of the free end of the shaft of the lifting tool for only a short distance, whereas the shaft itself extends for substantially the entire length of the tool. Thus it is possible to grasp the tool adjacent its upper end and push it so that the shaft and ears pass all the way through the aperture 27. It is therefore possible to rotate the tool so that the ears engage the reverse side of the lifting structure 26 from that visible in FIG. 4. Thereafter it is also possible to lift the cover plate 12 supported by way of engagement of the ears of the lifting tool with the aforesaid reverse side of the lifting structure 26.

The lifting tool includes at its end opposite the ears a handle that facilitates safe lifting of the cover plate 12.

As indicated such a lifting tool is known in the manhole assembly art, but on the other hand a novel feature of the invention is the provision of the lifting structure including the aperture 27 in a region of the cover plate 12 that is in normal use completely obscured by the frame 11.

The first cover plate 12 is retained relative to the frame 11 by a locking arrangement described in more detail hereinbelow. This arrangement means that to the casual observer there is no obvious way of removing the first cover plate 12 from the frame 11. This renders the manhole assembly of the first embodiment of the invention highly resistant to unauthorised removal of the first cover plate 12.

When the cover plates 12, 13 occupy the position shown in FIG. 1 the tongues 21 of the hinges 18, 19 overlie the pockets 22 of the second cover plate 13.

Figure 5:
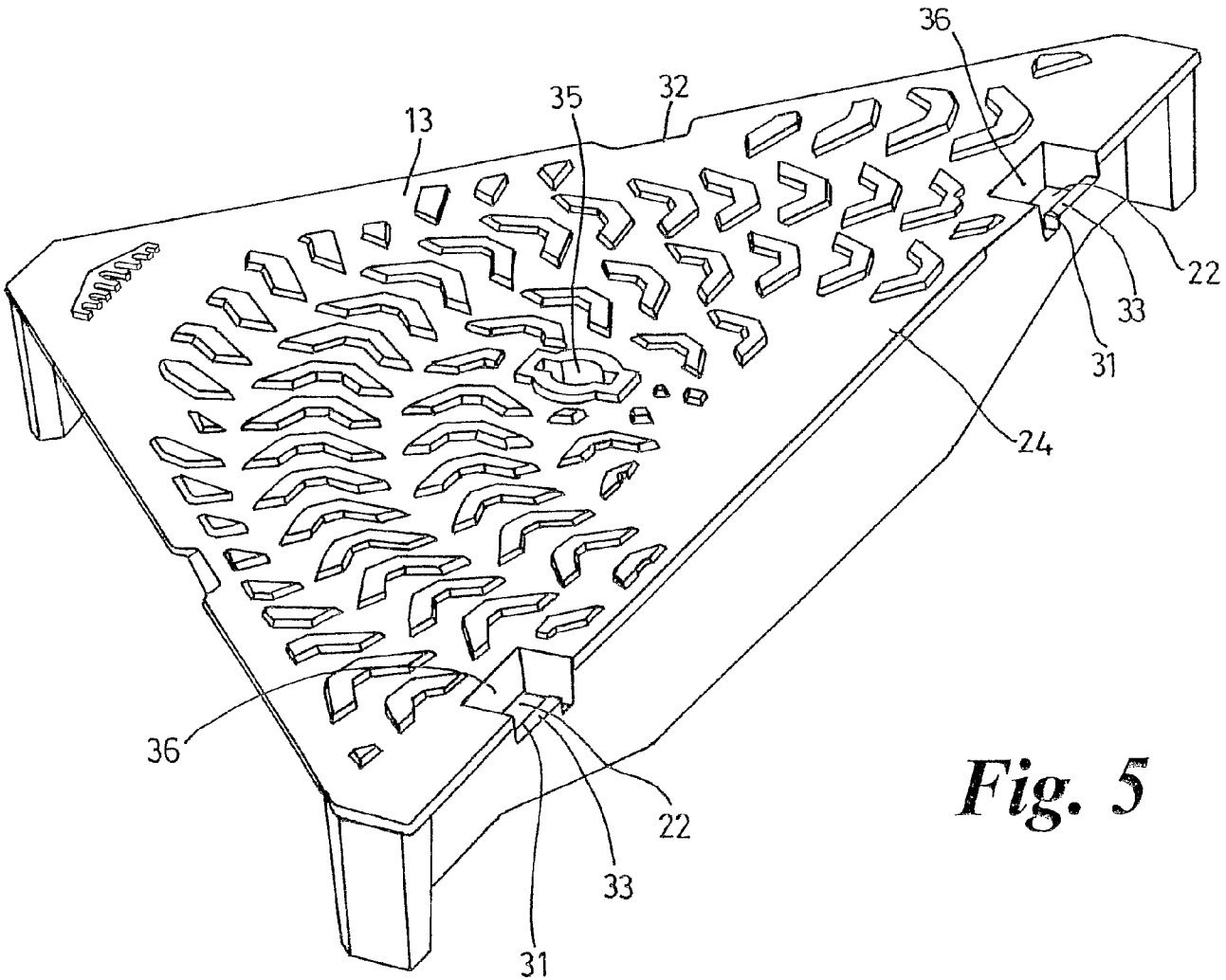
FIG. 5 is a perspective view from above of a second cover plate forming part of the assembly, of FIGS. 1 and 2.

As probably best shown in FIG. 5, each pocket 22 includes a lower wall 31 that is engageable with a said tongue 21.

When the first cover plate 12 is locked into the frame 11 in the manner described hereinbelow therefore, the tongues 21, together with a tendency for the second cover plate to "wedge" in the frame 11 unless lifted straight up out of the frame, prevent upward lifting of the second cover plate 13 out of the frame 11.

This is so notwithstanding the presence of a further lifting structure defined as a through-going aperture 33 of the same size and shape as aperture 27 formed in the first cover plate 12.

In other affords, it is necessary to release the lock that retains the first cover plate 12 in the frame 11 in order to remove the first cover plate 12. Such releasing of the first cover plate 12 also unlocks the second cover plate 13 to permit its removal from the frame. Thus a partial function of the first cover plate 12 is to act as a locking member for retaining the second cover plate 13 in the position shown in FIG. 1 of the accompanying drawings.

FIG. 5 shows that each pocket 22 includes at its forwardmost edge adjacent the hypotenuse 24 a protuberance in the form of a lip 33 extending upwardly from the lower pocket wall 31.

Each tongue 21 includes protruding from its lowermost side a downwardly depending protuberance in the form of a rib 34.

When the first cover plate occupies its third orientation, the ribs 34 and the lips 33 engage one another. At the same time each tongue 21 engages the back wall 36 of the pocket 22 in which it is inserted, whereby the tongues 21, the lips 33 the ribs 34 and the back wall 36 react the mass of the first cover plate 12 to prop the latter in an open position protruding upwardly from the second cover plate 13.

The locking arrangement of the first cover plate 12 is best described with reference to FIGS. 2 and 4.

As used herein "locking arrangement" is intended to mean an arrangement for securing the cover plates in the frame so as to prevent, discourage or inhibit their unauthorised or unwanted removal from the frame. "Locking" herein does not necessarily imply the use of a padlock or other key-operated means for securing the covers. Terms such as "locking tongue", "locking tab" and the like are to be construed accordingly.

On its underside first cover plate 12 includes secured thereto (and in practice cast integrally therewith) a locking tongue 37. Locking tongue 37 protrudes towards lifting structure 26 from a boss 38 itself protruding downwardly from the underside of first cover plate 12 at a location spaced from lifting structure 26.

Tongue 37 protrudes downwardly from the underside of cover plate 12 to a greater extent than a wall 39 that also depends downwardly therefrom adjacent the periphery of plate 12. The purpose of wall 39 is primarily to strengthen the cover plate 12 and support the lifting structure 26 by reason of being connected thereto in the vicinity of apex 12*c*.

In the vicinity of portion 16*b* frame 11 includes an in-use upwardly directed shoulder 41 that together with further shoulders 42, 43 provide seatings for the first cover plate 12 when the latter is received in the frame 11.

Similar seatings are also formed protruding inwardly from wall 16 at locations not visible in eg. FIG. 2, for the purpose of supporting the second cover plate 13 in like manner to the cover plate 12. The precise details of the seatings in the frame 11 will be known to those of skill in the relevant art.

A tab 42 protrudes inwardly from seating 41 a short distance towards the centre of the manhole assembly as best shown in FIG. 2. The tab 42 is located and shaped so as to be engageable by the locking tongue 37 when the first cover plate 12 is inserted into the frame.

This is achieved in the preferred embodiment by reason of the locking tongue 37 being resiliently deformable. This in turn results from casting of the first cover plate 12 from ductile iron.

At a free end spaced a short distance from lifting structure 26 locking tongue 37 terminates in a cam surface 43 that is inclined to the vertical when the first cover plate 12 is in its first orientation as shown in FIG. 1.

Visible below cam surface 43 in FIG. 4 (and hence lying above cam surface 43 in use of first cover plate 12) is a locking surface 44 that is also inclined relative to the vertical. Thus the cam surface 43 and locking surface 44 between them define a generally triangular protuberance that protrudes on one side of the free end of locking tongue 37 that lies remote from boss 38.

Tab 42 includes a similar triangular protuberance defined by a further cam surface 46 beneath which lies a further locking surface 47, the surfaces 46, 47 being inclined relative to the vertical in a similar manner to the surfaces 43, 44.

Thus on insertion of the first cover plate 12 into the frame 11 when the second cover plate 13 is seated on its seatings causes firstly the tongues 21 to overlie the lower walls 31 of the pockets 21; and secondly the cam surface 43 initially to engage the further cam surface 46. Downward pressure caused eg. by the weight of a worker causes the cam surfaces 43, 46 to slide one over the other while simultaneously causing lateral movement of the locking tongue 37 against its resilience.

Once the apices of the respective triangular protuberances defined on the one hand by the surfaces 43, 44 and on the other hand by the surfaces 46, 47 have passed one another the same resilience drives the locking tongue 37 back towards the position shown in FIG. 4 such that the locking surfaces 44, 47 slide one over the other. This draws the first cover plate 12 snugly into locking location in the frame 11 whilst simultaneously locking the second cover plate 13 in place.

When thus secured (as shown in FIG. 1) it is not immediately apparent how to release the first cover plate 12 from the frame 11.

For the purpose of releasing the first cover plate 12, however, the latter includes adjacent the lifting structure 26 on either side of the first cover plate 12 a trapezoidal recess 48. Each recess 48 is shaped and dimensioned to receive a per se known prising bar by means of which the first cover plate 12 may be levered upwardly in a reversal of the above-described locking mechanism.

By reason of the resilient deformability of the locking tongue 47 such a prising action causes the first cover plate 12 to "pop" upwardly of the frame, thereby exposing the aperture 27 forming part of the lifting structure 26. It is thence a straightforward procedure to insert a lifting tool into the aperture 27 in the manner described hereinabove for the purpose either of removing the first cover plate 12 from the frame 11 (when the first cover plate 12 occupies its second orientation relative to the second cover plate) or of rotating the first cover plate 12 to its third orientation relative to the second cover plate 13.

Following complete removal of the first cover plate from the frame 11 it is possible to use the lifting tool inserted into the aperture 35 for lifting of the second cover plate 13 clear of the frame.

Figure 6:
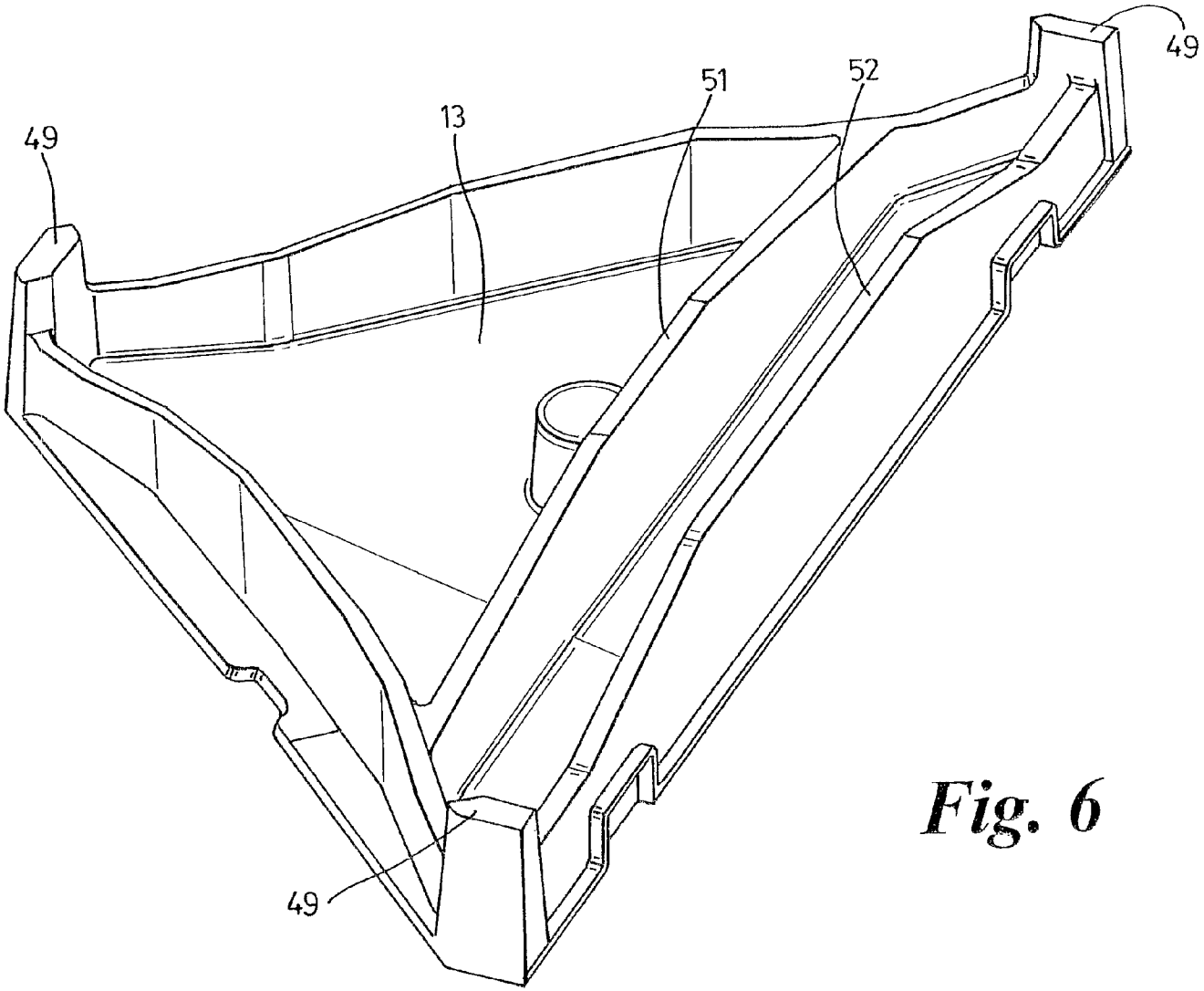
FIG. 6 is a perspective view from underneath of the FIG. 5 cover plate.

As best shown in FIGS. 4 and 6 the underside of each cover plate 12, 13 includes formed in a triangular pattern a series of three feet 49 that are engageable in the seatings formed in the frame 11 so as to provide a non-rocking mounting of the cover plates in a per se known manner.

As is also evident from FIGS. 4 and 6 second cover plate 13 includes extending downwardly from its underside a pair of parallel strengthening ribs 51, 52 that extend generally parallel to the hypotenuse of the second cover plate.

In contrast the first cover plate 12 includes only a single rib 39 extending generally parallel to its hypotenuse.

This arrangement of ribs is one of the principal reasons why the combined weight of the cover plates 12, 13 of unequal sizes is less than the mass of a pair of equally sized cover plates of the same dimensions. In the prior art cover plates there are two strengthening ribs protruding downwardly from the underside of each such plate.

FIG. 2 shows that the peripheral flange 17 of the frame 11 is of varying width, being at its narrowest at the locations 17*a* intermediate the corners of the frame.

This arrangement has been found advantageously to concentrate the strength of the frame 11 at its corners, where (experience has shown) the frame 11 typically is subject to the greatest stresses.

Furthermore the frame 17 although secured continuously about the peripheral of the upstanding wall 16 additionally includes at intervals strengthening fillets 53 of a per se known L-shaped construction formed on the exterior of wall 16 and on the upper surface of flange 17.

At its corners flange 17 includes an array of generally mutually parallel ribs 54 protruding upwardly from the surface of the flange 17 and generally aligned parallel to the diagonals of the frame 11. Thus the ribs 54 represent a series of protuberances spaced from one another by recesses.

Such an arrangement has been shown very advantageously to confer good stiffening and keying characteristics on the frame 11. However, other arrangements of keying and/or strengthening members may if desired be present in the flange 11 and/or the upstanding wall 16. In particular, the stiffening and/or keying members may be present on the upper surface alone of flange 17; on the lower surface alone of the flange 17; or on both the upper and lower surfaces thereof. Moreover the ribs and recesses may extend in directions other than those shown.

Figure 7:
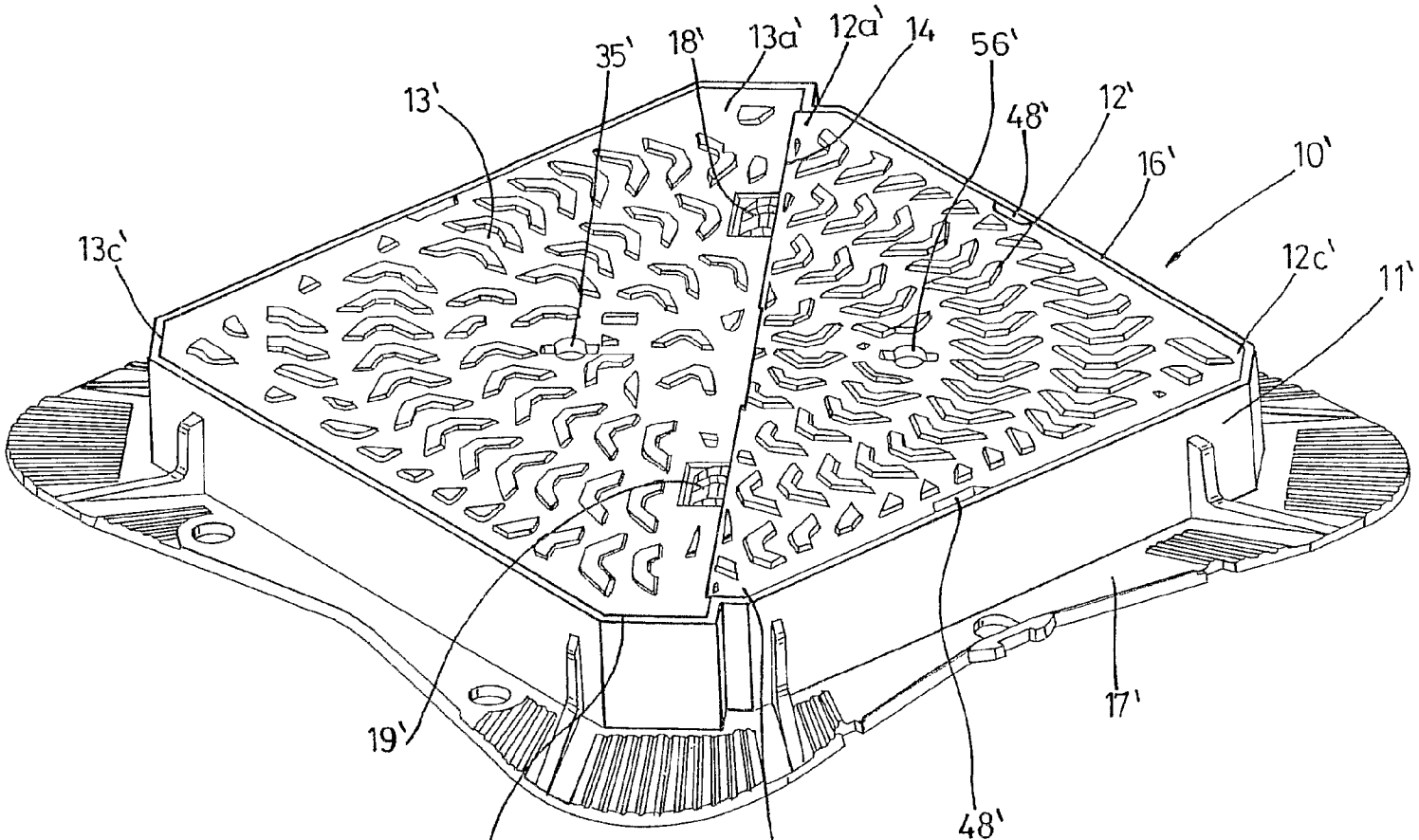
FIG. 7 is a view, that is similar to FIG. 1, of a second embodiment of manhole assembly according to the invention.
Figure 8:
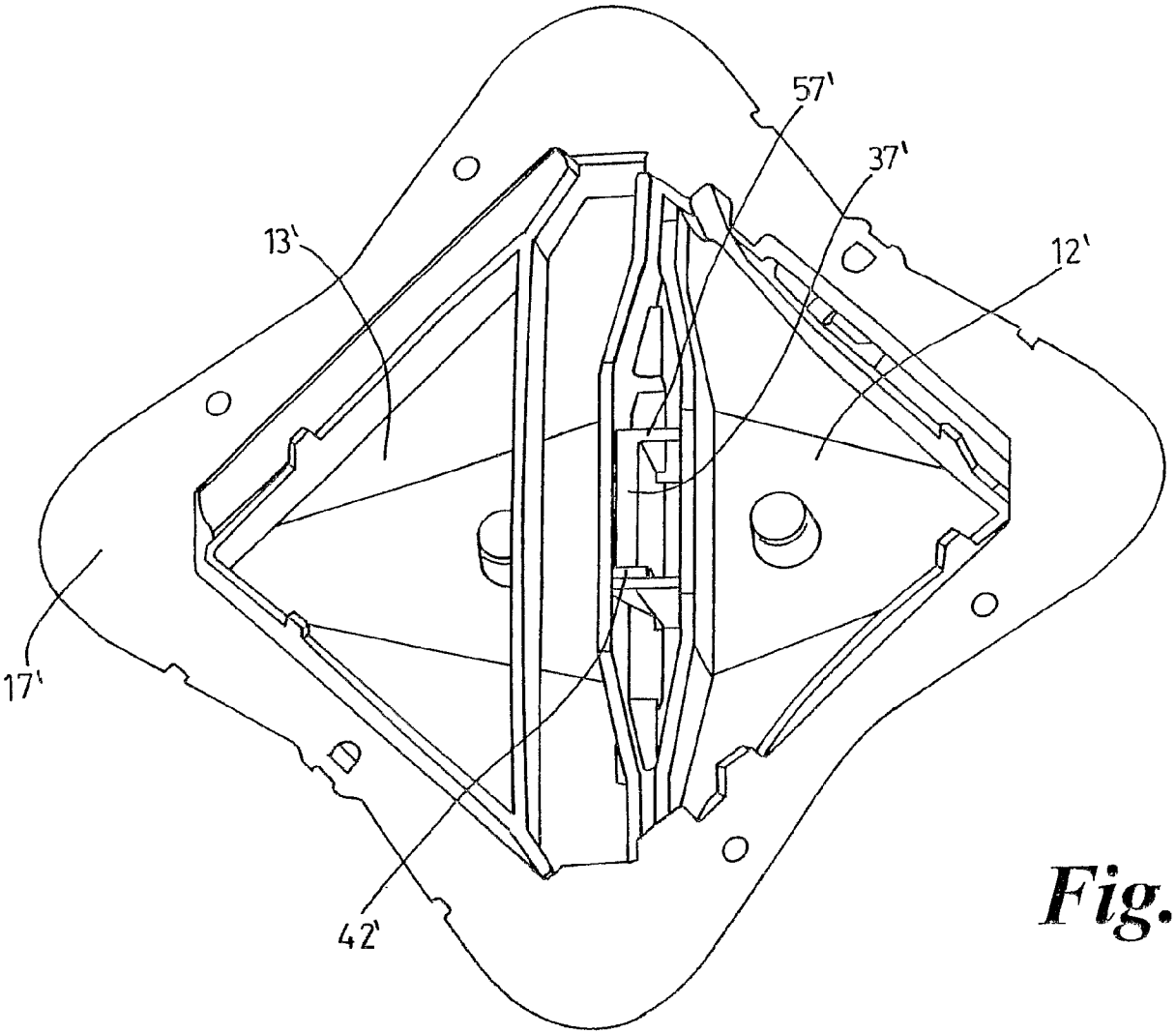
FIG. 8 is a perspective view from underneath of the manhole assembly of FIG. 7.

Referring now to FIG. 7 there is shown a second embodiment 10' of manhole assembly according to the invention.

The second embodiment is in some respects similar to the first embodiment of FIGS. 1 to 6, such that the following description refers primarily to the differences between the embodiments. In the following description the features of the second embodiments that are present in the first embodiment are identified by the same reference numerals, modified by the addition of an apostrophe.

The second embodiment of manhole assembly 10' according to the invention differs from that of FIGS. 1 to 6 firstly by reason of omitting the protruding lifting structure 26. Instead the first cover plate 12' includes a lifting aperture 56' that is of very similar or identical design to aperture 35 of cover plate 13 and its counterpart feature 35' formed in cover plate 13'.

Consequently at apex 12' the upstanding wall 16' of frame 11' resembles the vicinity of apex 13' at the diagonally opposite corner of the frame 11'.

It follows that the locking arrangement of the second embodiment of the invention differs from that of the first embodiment. The differences are illustrated with reference to FIGS. 8, 10, 12, 13, 14, 15 and 16 hereof.

The first cover plate 12' omits the locking tongue 37 that protrudes towards the apex 12*c* of the first cover plate 12 described hereinabove. Instead all alternative design of locking tongue 37' protrudes from a location adjacent the hypotenuse 23' of the first cover plate, below the uppermost surface thereof.

In practice the locking tongue 37 is spaced outwardly of the downwardly depending wall 39' of the first cover plate 12, being braced thereagainst by reason of attachment to an interposed reinforcing fillet 57'.

Figure 12:
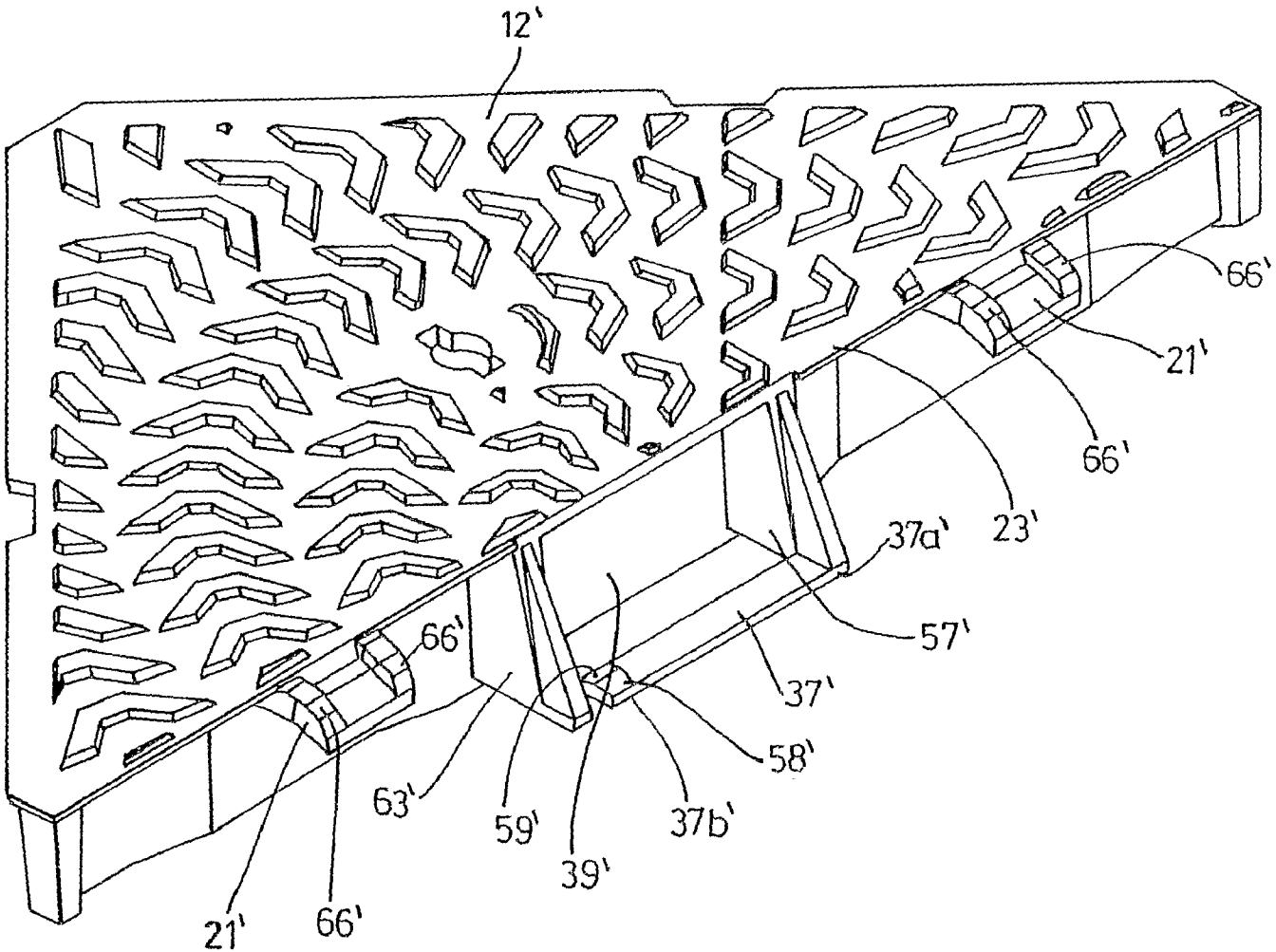
FIG. 12 is a perspective view from above of a first cover plate of the manhole assembly of FIGS. 7 to 11.
Figure 13:
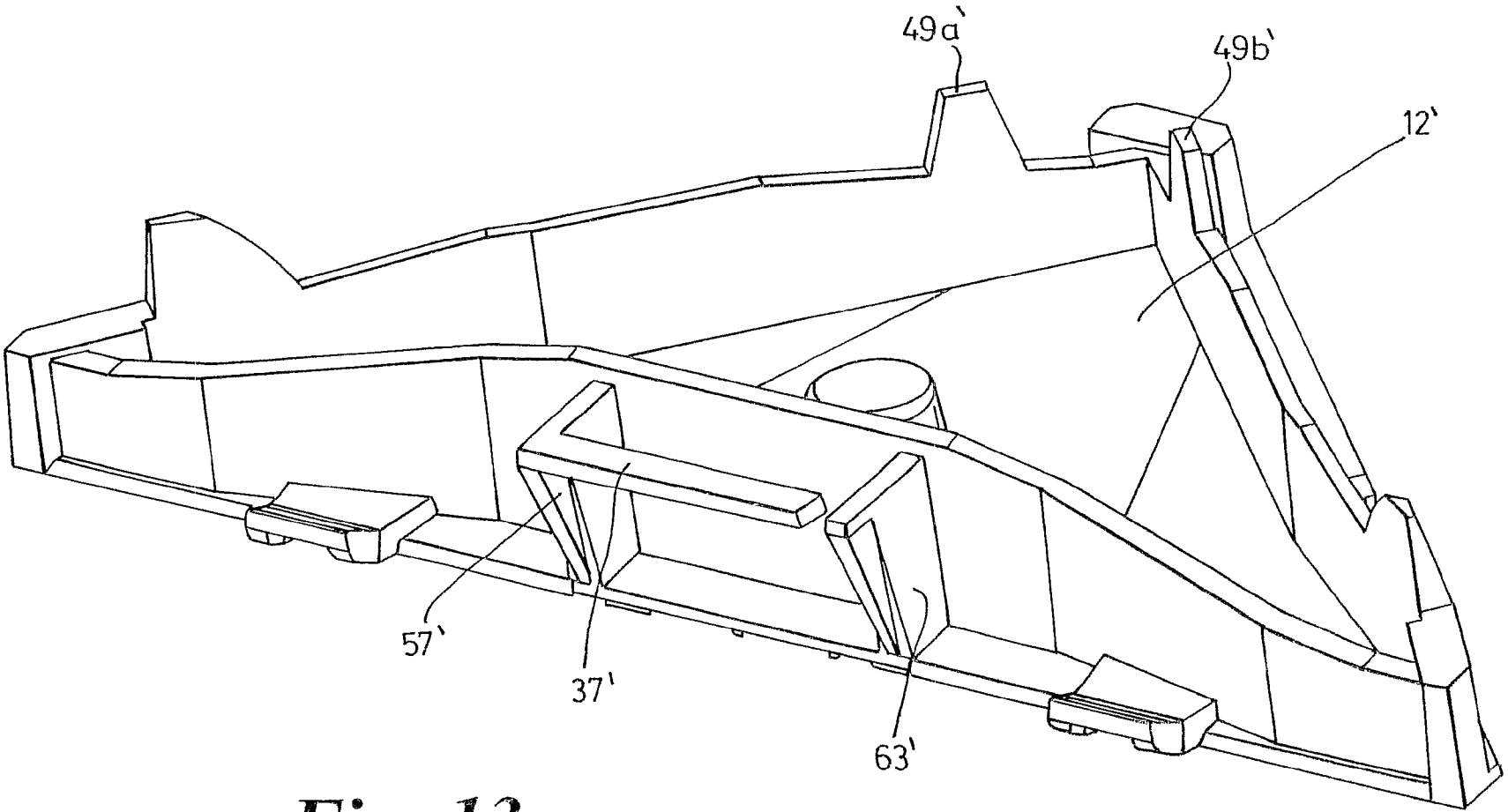
FIG. 13 is a perspective view showing the FIG. 12 cover plate from underneath.
Figure 14:
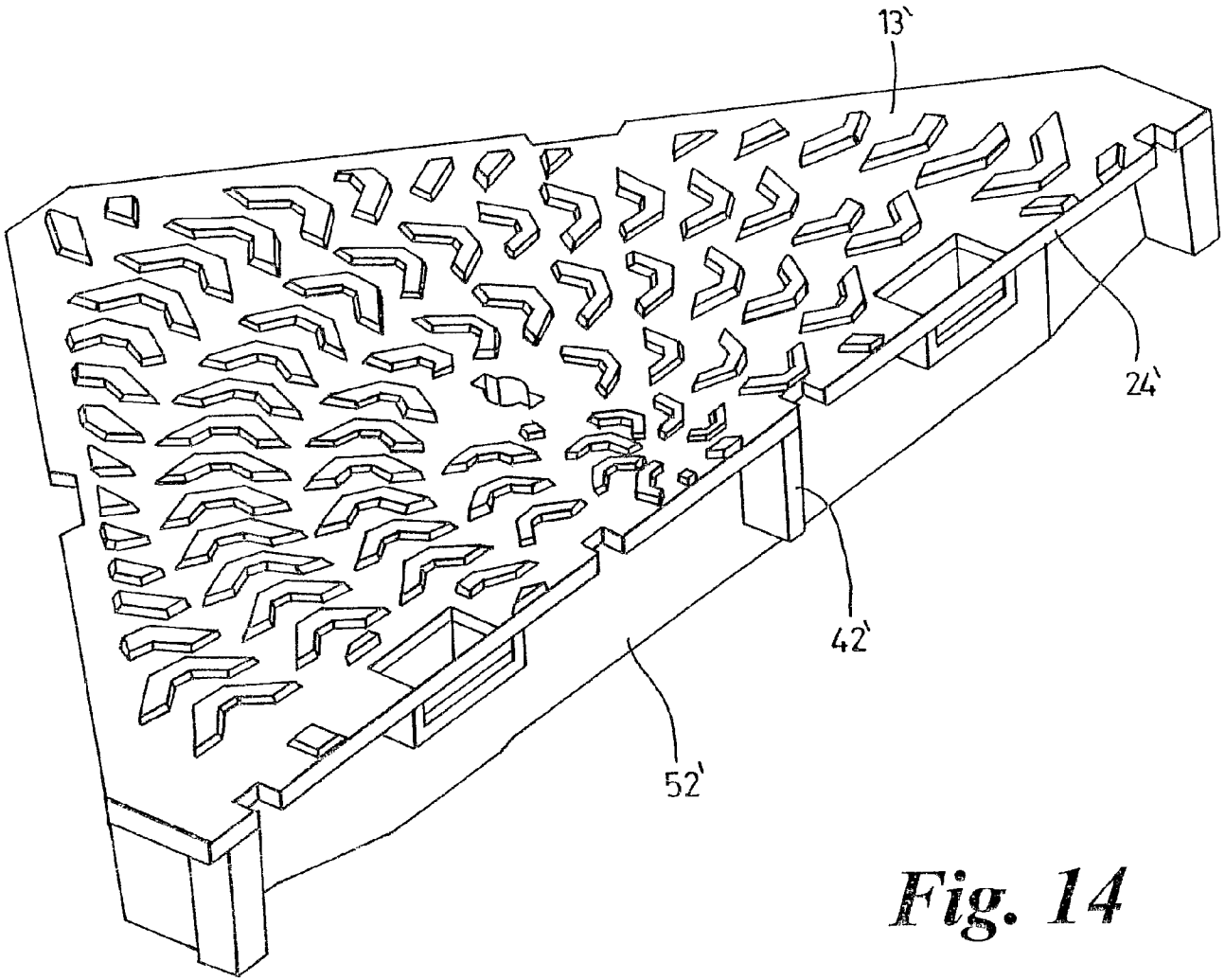
FIG. 14 is a perspective view from above of a second cover plate of the manhole assembly of FIGS. 7 to 11.
Figure 15:
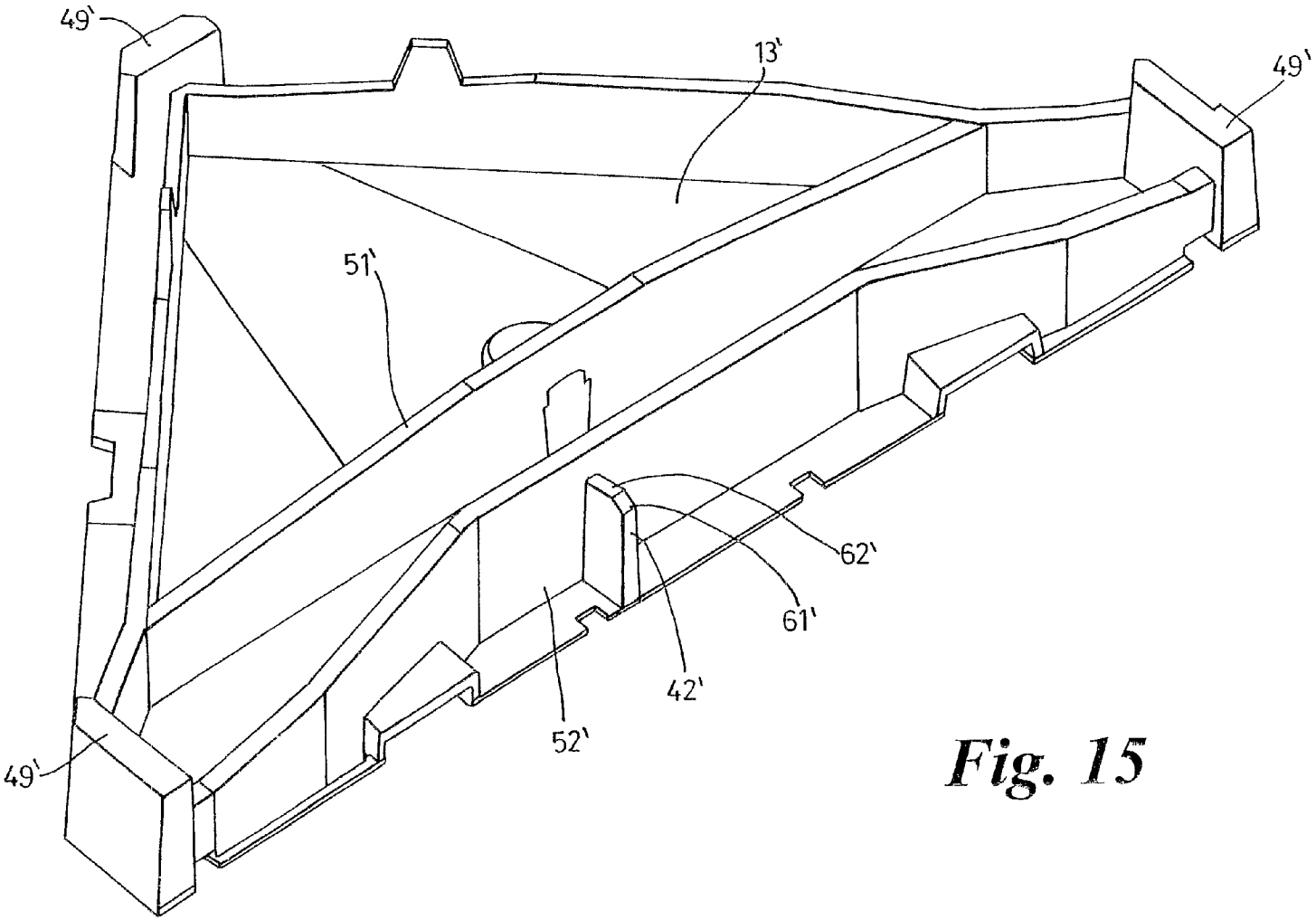
FIG. 15 is a perspective view from underneath of the FIG. 14 cover plate.

As is apparent from FIG. 12, locking tongue 37' presents an in-use horizontal, generally flat bar that extends parallel to wall 39'. At one end 37*a*' locking tongue 37' is secured to the fillet 57'. At its opposite end 37*b*' locking tongue 37' is unrestrained.

On the in-use upwardly facing surface of locking tongue 37', adjacent free end 37*b*' is formed a pair of inclined surfaces 58', 59 the first 58' of which is a cam surface and the second 59' of which is a locking surface.

The locking tongue 37' is cast (in practice integrally with the remainder of cover plate 12') from a resiliently deformable material such as ductile iron.

A locking tab 42' with which locking tongue 37' is engageable is formed as a wall protruding outwardly from rib 52' of second cover plate 13' that extends parallel to hypotenuse 24' thereof. At its upper end tab 42' is secured to the underside of the deck of the cover plate 13'.

Tab 42' includes respective, inclined surfaces 61' and 62' that between them define a triangular protuberance on the underside of the tab 42'.

Surface 61' is a cam surface; and surface 62' is a locking surface.

Figure 9:
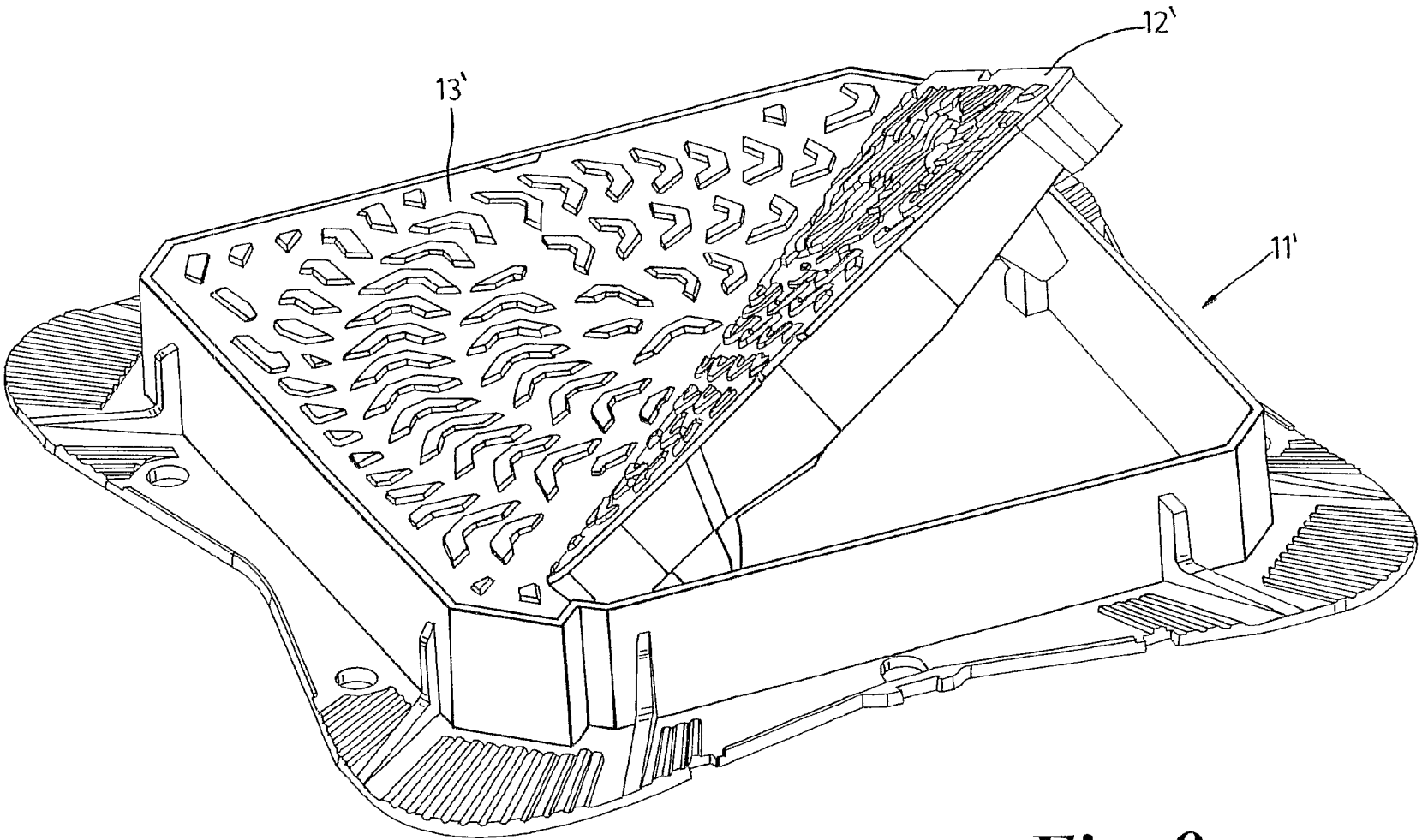
FIG. 9 shows in perspective view the assembly of FIGS. 7 and 8, with a first cover plate thereof in a partially open position relative to a second cover plate thereof.

As is apparent from comparison between FIGS. 7 and 9 the first cover plate 12' is pivotable relative to the second cover plate 13 between an open position such as that shown in FIG. 9 and a closed position such as that shown in FIG. 7.

This action causes the respective cam surfaces 58', 61' initially to engage the locking tongue 37' and then bend it downwardly against its resilience.

Once the apices of the respective triangles formed by the inclined surfaces 58', 59' on the one hand and 61', 62' on the other pass over one another by reason of continued movement of the first cover plate 12' in a downward direction, the resilient deformability of the locking tongue 37' causes it to snap into locking engagement with the tab 42' by reason of the surfaces 59' and 62' engaging one another.

At the same time, the fillet 57' braces against the rib 52'. A further fillet 63' of similar shape and size to fillet 57' is spaced from the latter to provide even bracing of the cover plates 12', 13' one relative to the other.

Figure 16:
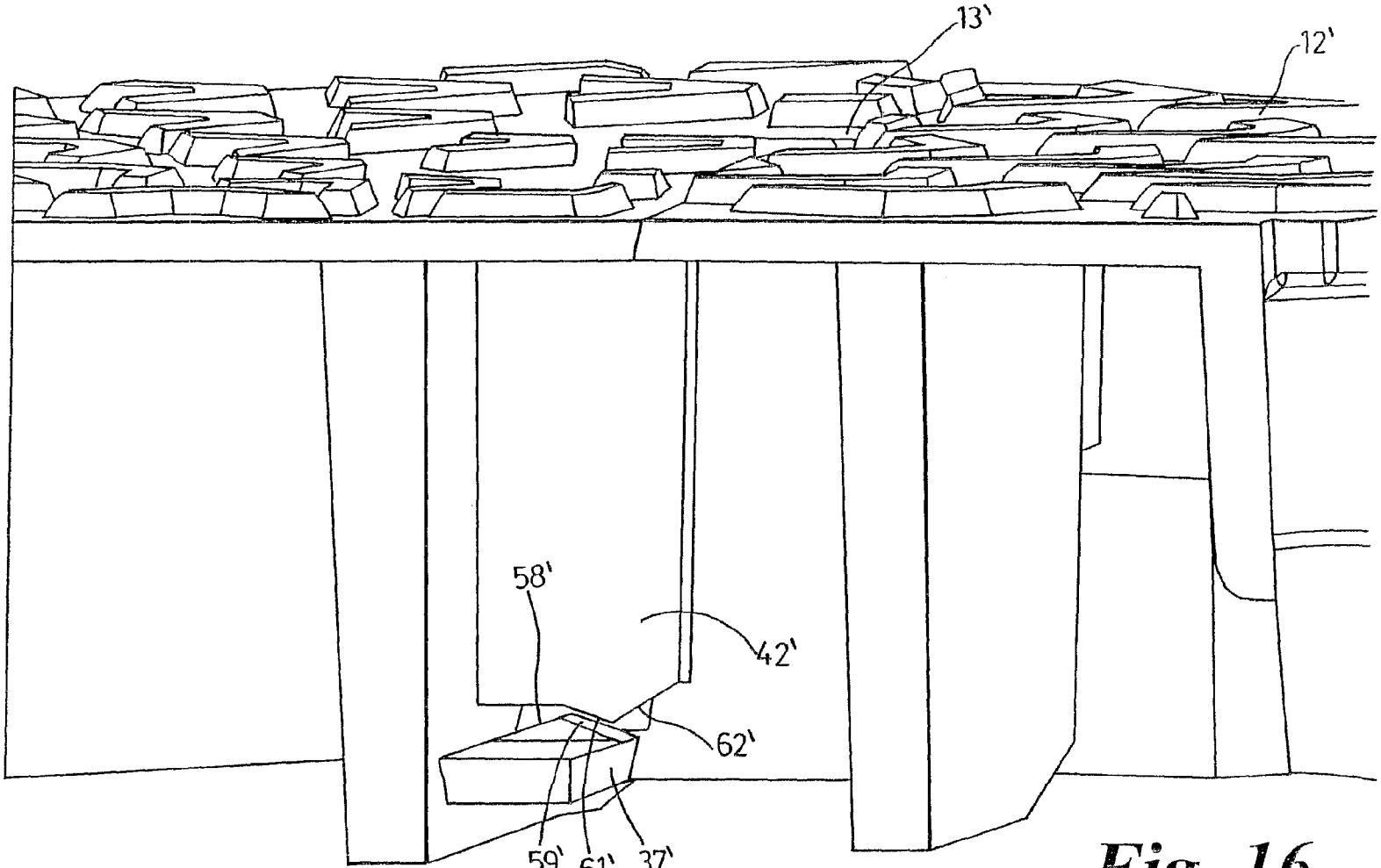
FIG. 16 is a perspective partly sectioned view, of the cover plates of the FIG. 7 arrangement.

The arrangement of the locking tongue 37' and the tab 42' when in the locked position is best shown in FIG. 16, in which a small clearance between the locking surfaces 59' and 62' is visible. The purpose of the clearance is to ensure that the locking tongue 37' is not load bearing in use of the manhole assembly since this could lead to a rocking (ie. noisy) operation and could also cause premature wear of either the tab 42' or the locking tongue 37'.

A further difference between the first and second embodiments of the invention is in relation to the hinge tongues 21' and the pockets 22' of the second embodiment.

Figure 11:
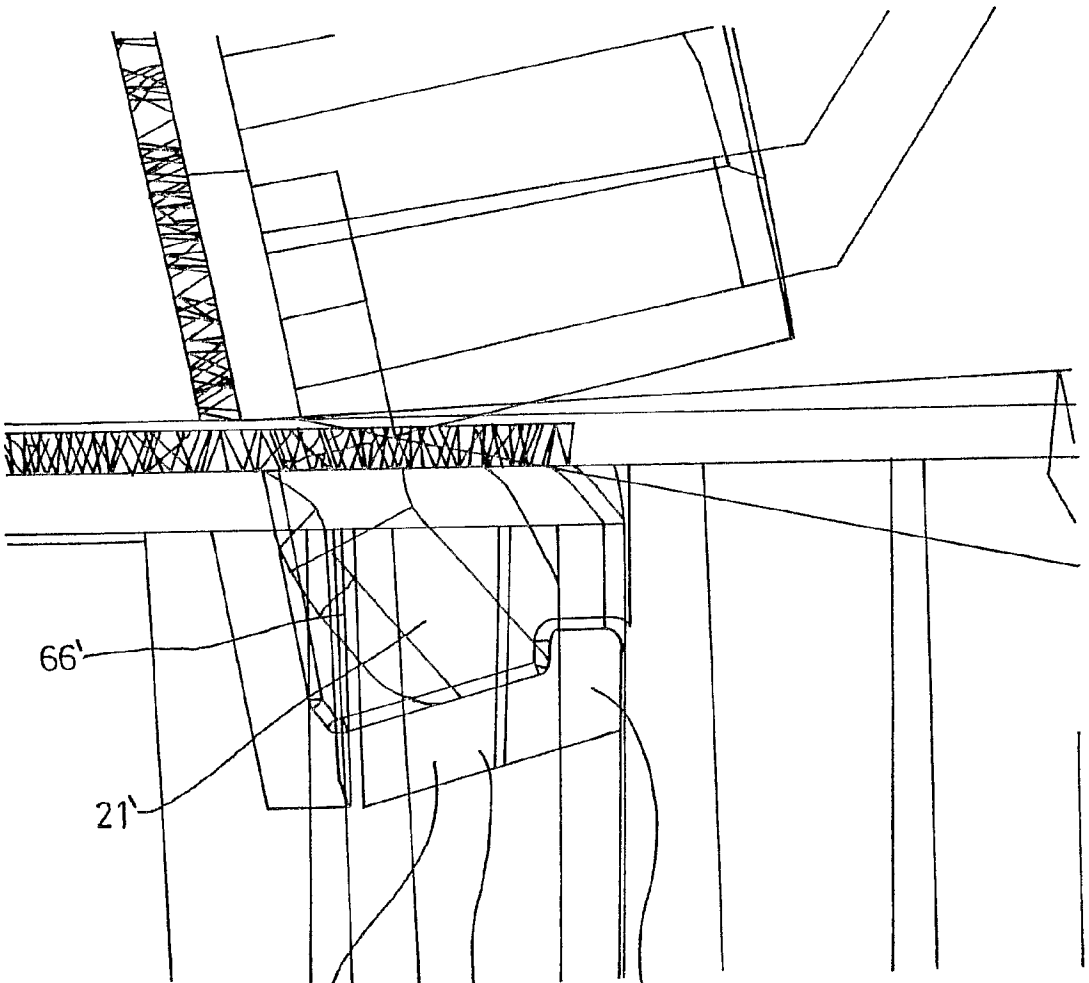
FIG. 11 is a schematic view showing interaction between components of a hinge when the manhole assembly is in the configuration shown in FIG. 10.

As best seen in FIGS. 11 and 12, the hinge tongues 21' are substantially hook-shaped, with the arc of the hook extending downwardly when the first cover plate 12' occupies its first orientation relative to the second cover plate 13'.

At its fowardmost edge the pocket 22' includes an upstanding wall 64' protruding upwardly from the lower pocket wall 31'.

Figure 10:
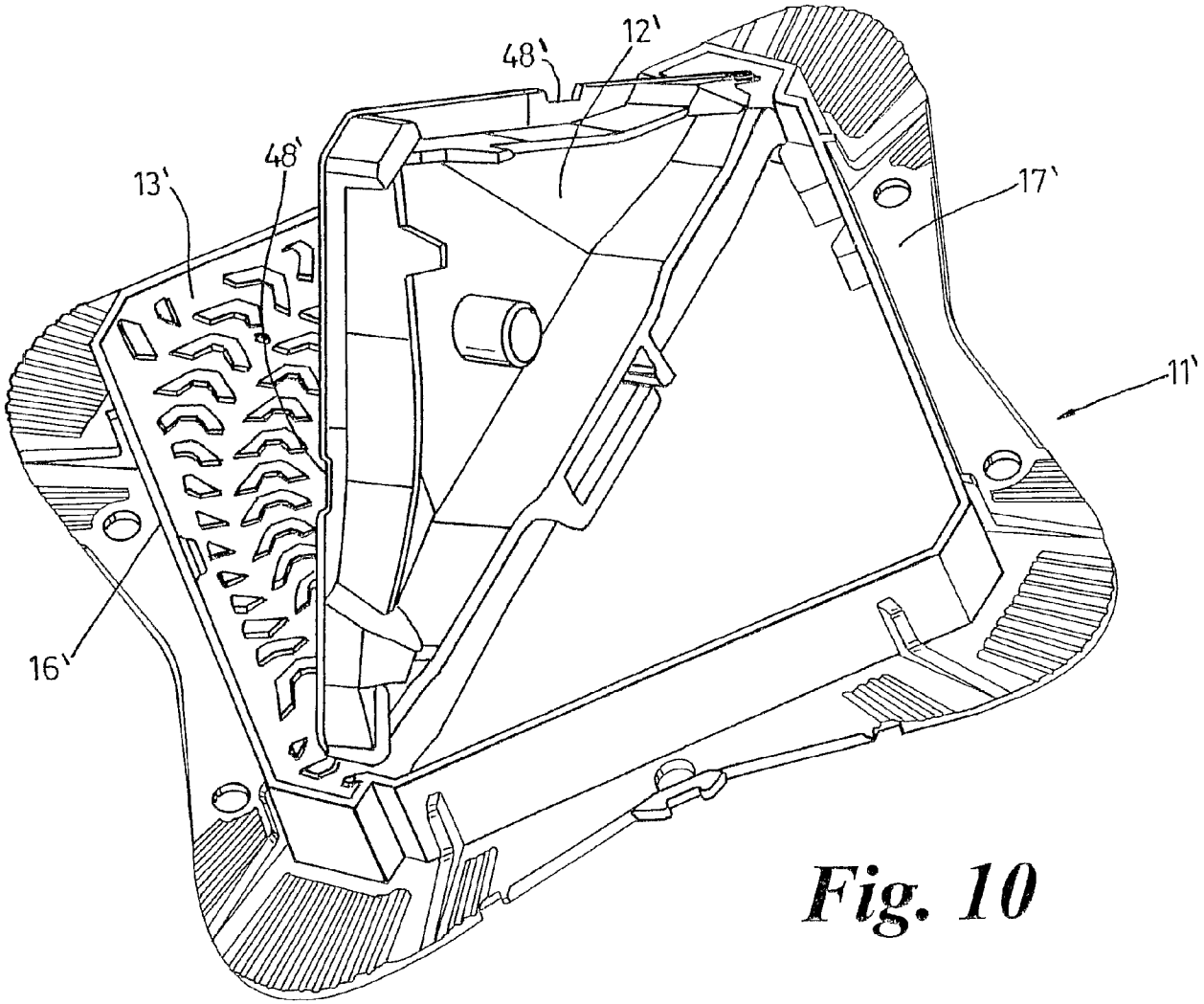
FIG. 10 is a view that is similar to FIG. 9 except that the first cover plate is in a fully open position.

When the first cover plate adopts its third orientation, as shown in FIG. 10, relative to the second cover plate 13', the free end of each tongue 21' engages the adjacent upstanding wall 64' in the manner of the tongues 21 of the first embodiment of the invention.

On their upper sides the tongues 21' have extending along each edge a rib 66' that acts as a cam surface, so as to engage the walls of the pockets 22', during movement of the first cover plate 12' between the first orientation shown in FIG. 7 and the third orientation shown in FIG. 10, via the second orientation shown in FIG. 9.

The action of closing the aperture defined by the frame 11' is similar to that of closing the aperture defined by frame 11 of the first embodiment.

Thus the second cover plate is initially inserted into the correct half of the frame 11' such that its three feet 49' seat on corresponding seatings protruding inwardly from the relevant parts of the wall 16'. Next the tongues 21' are inserted into the pockets 22' and the first cover plate 12' pivoted downwardly towards its first orientation.

Towards the last part of this movement the inclined surfaces 58', 61' engage one another and inhibit further movement in the same direction unless force, such as may be applied by the foot of a worker, acts downwardly on the first cover plate 12'.

In this configuration the tongue 37' and tab 42' together with the bracing provided by the fillets 57' and 63' couple the first and second cover plates together so that they can be lifted as a pair following insertion of respective lifting tools into the apertures 35', 56' visible eg. in FIG. 7. In this manner the second cover plate 13' to some extent supports the mass of the first cover plate 12' in cantilever fashion.

As a consequence it is possible rapidly to open the entire aperture defined by the frame 11' of the second embodiment, assuming two workers are available to provide the necessary strength for lifting via the two lifting tools that need to be employed for this purpose.

In addition to the foregoing mode of opening of the second embodiment of the invention, it is possible to apply a prising bar to one or both of the trapezoidal prising bar apertures 48' formed respectively in the non-hypotenuse edges of the first cover plate 12' and thereby overcome the resilient bias of the locking tongue 37'.

This action causes the first cover plate 12' to become released from its locked configuration, whence it may be pivoted by way of the hinges 18', 19' to an open position.

From such a position the first cover plate 12' may be separated from the second cover plate 13', although of course the lifting structure 26 that facilitates such action in the first embodiment of the invention is as noted absent from the second embodiment.

The second cover plate 13' may if desired then separately be lifted from the frame 11'.

It is believed that the first embodiment of the invention as described herein confers a good degree of security on the locking of the cover plates in the frame of the assembly. The second embodiment provides the additional benefit of being able to remove both the cover plates simultaneously in the manner described hereinabove.

At its end 12*c*' the first cover plate 12' includes a pair of downwardly depending feet 49*a*', 49*b*' that seat on a shoulder (not shown in the drawings) facing upwardly at a location below the upper edge of wall 16' in the vicinity of apex 12*c*' when the first cover plate 12' occupies its first orientation as shown in FIG. 7. The feet 49*a*', 49*b*' are sufficiently closely spaced as not to detract from the non-rocking nature of the support needed for the first cover plate 12'.

Figure 18:
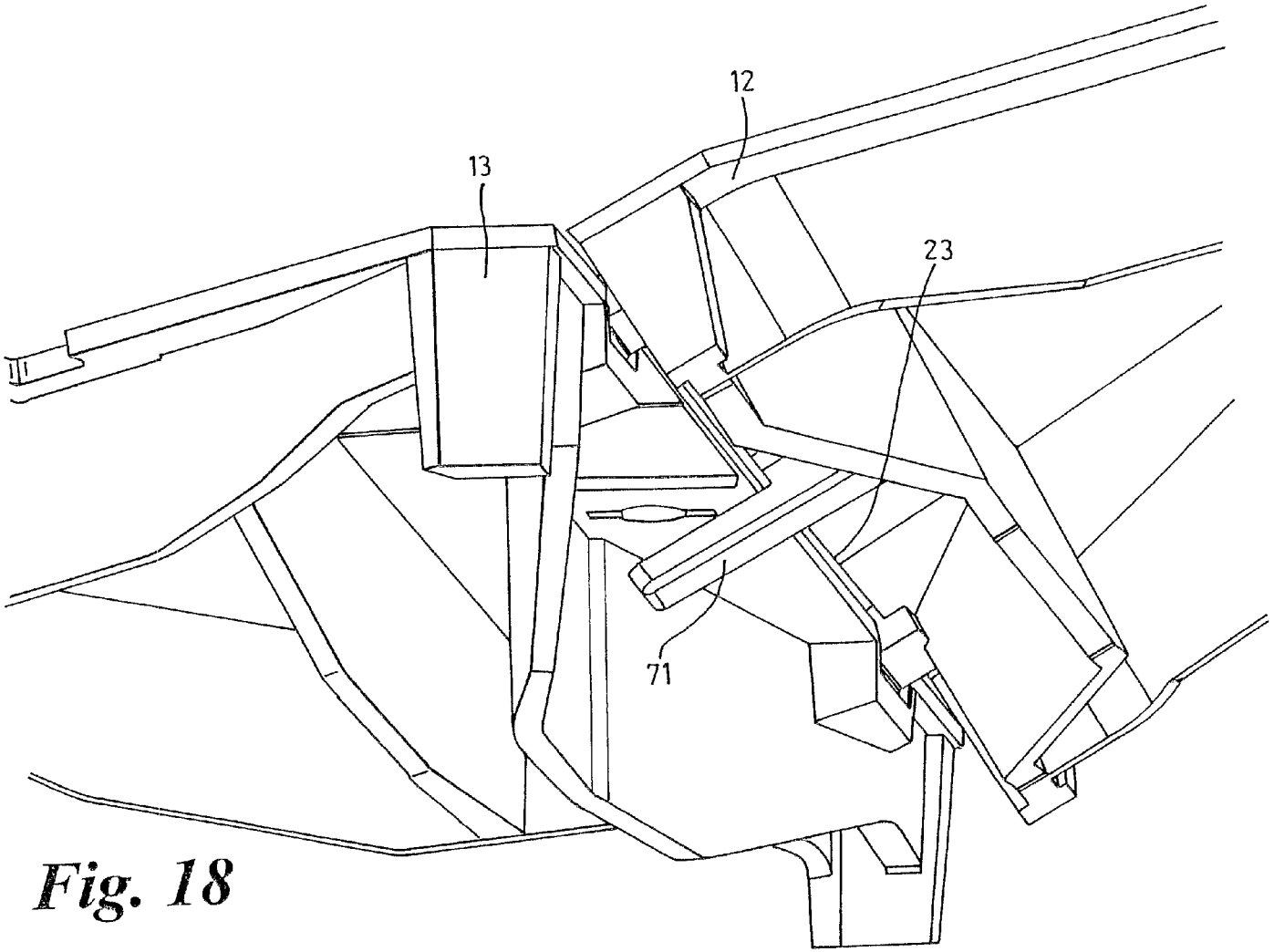
FIG. 18 is a perspective view, from underneath of the cover plates of the assembly of a further embodiment of the invention, with the first cover plate occupying a second orientation relative to the second cover plate.
Figure 19:
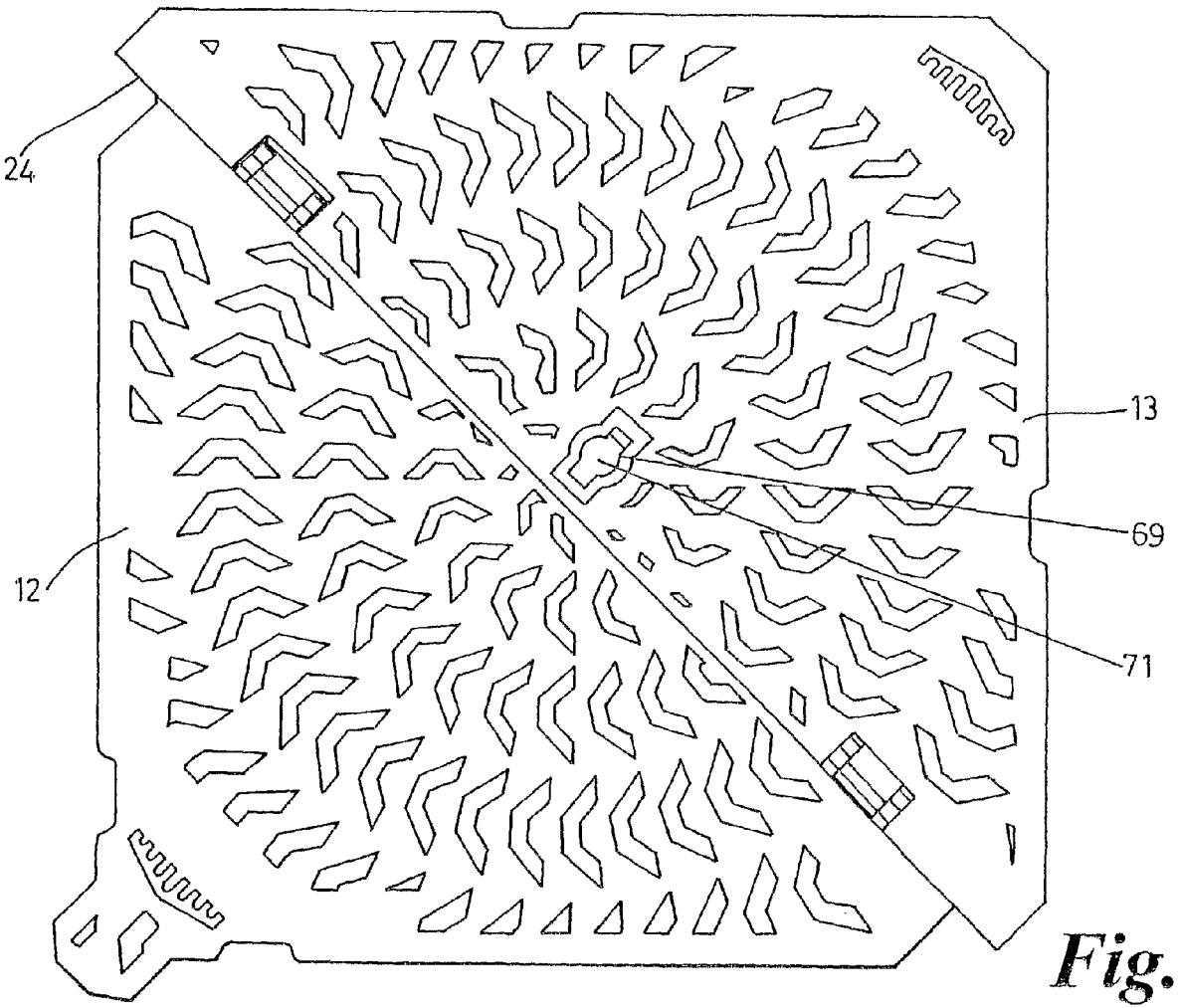
FIG. 19 is a plan view from above of the FIG. 18 cover plates, when both are received in a manhole frame.

FIGS. 18 and 19 hereof show a further variant that may be employed in embodiments of the invention. These figures show the variant with reference to the first embodiment of the manhole assembly described herein; but the variant is equally applicable to other embodiments, including the second embodiment, albeit perhaps with modification that will occur to those of skill in the art.

In FIGS. 18 and 19 the second cover plate 13 of the pair includes formed therein a lifting recess in the form of a through-going aperture 69.

Aperture 69 is elongate as shown. Its major axis extends perpendicular to the hypotenuse 24, adjacent which it lies, of second cover plate 13.

In plan view (FIG. 19) the cross sectional shape of aperture 69 is of a commonplace kind used for receiving a lifting key as described hereinabove.

The hypotenuse 23 of the first cover plate 12 includes projecting, parallel to the top and bottom surfaces of the cover plate, a rectangular blanking plate (member) 71.

Blanking plate 71 protrudes from the underside of hypotenuse 23 and is so located that on hinging of the first cover plate 12 from its second orientation (shown in FIG. 18) towards its first (closed) orientation relative to second cover plate 13, blanking plate 71 pivots to a position underlying the lower end of aperture 69.

The location at which blanking plate 71 protrudes from the underside of hypotenuse 23 may be chosen so that plate 71 closes off the aperture 69 as a result.

This causes the covers of the manhole assembly to appear as shown in FIG. 19, ie. with the aperture 69 being a blind hole into which it is impossible to insert a conventional lifting key in such a way as to allow lifting of the second cover plate.

When as shown the FIG. 18/FIG. 19 features are incorporated into the first embodiment of manhole assembly according to the invention, the only means of lifting either cover plate, when the plates occupy the positions shown in FIG. 19, is the pair of trapezoidal recesses 48. To the casual observer the recesses appear unrelated to the function of lifting the cover plates, so the overall security of the assembly is improved as a result.

However when the first cover plate 12 is hinged to its second or third orientations the blanking plate is pivoted away from the lower end of aperture 69.

Consequently the latter then permits insertion of a lifting key in a manner allowing lifting of the second cover plate 13.

A further advantage of the blanking plate 71 is that it prevents most, if not all, kinds of debris from falling via the aperture 69 into the chamber or other feature that is capped by the manhole assembly.

In further embodiments of the FIG. 18/FIG. 19 arrangement the number and/or location of the aperture(s) 69, and hence of the blanking plate(s) 71 may be varied in ways that will occur to those of skill in the art.

Figure 17:
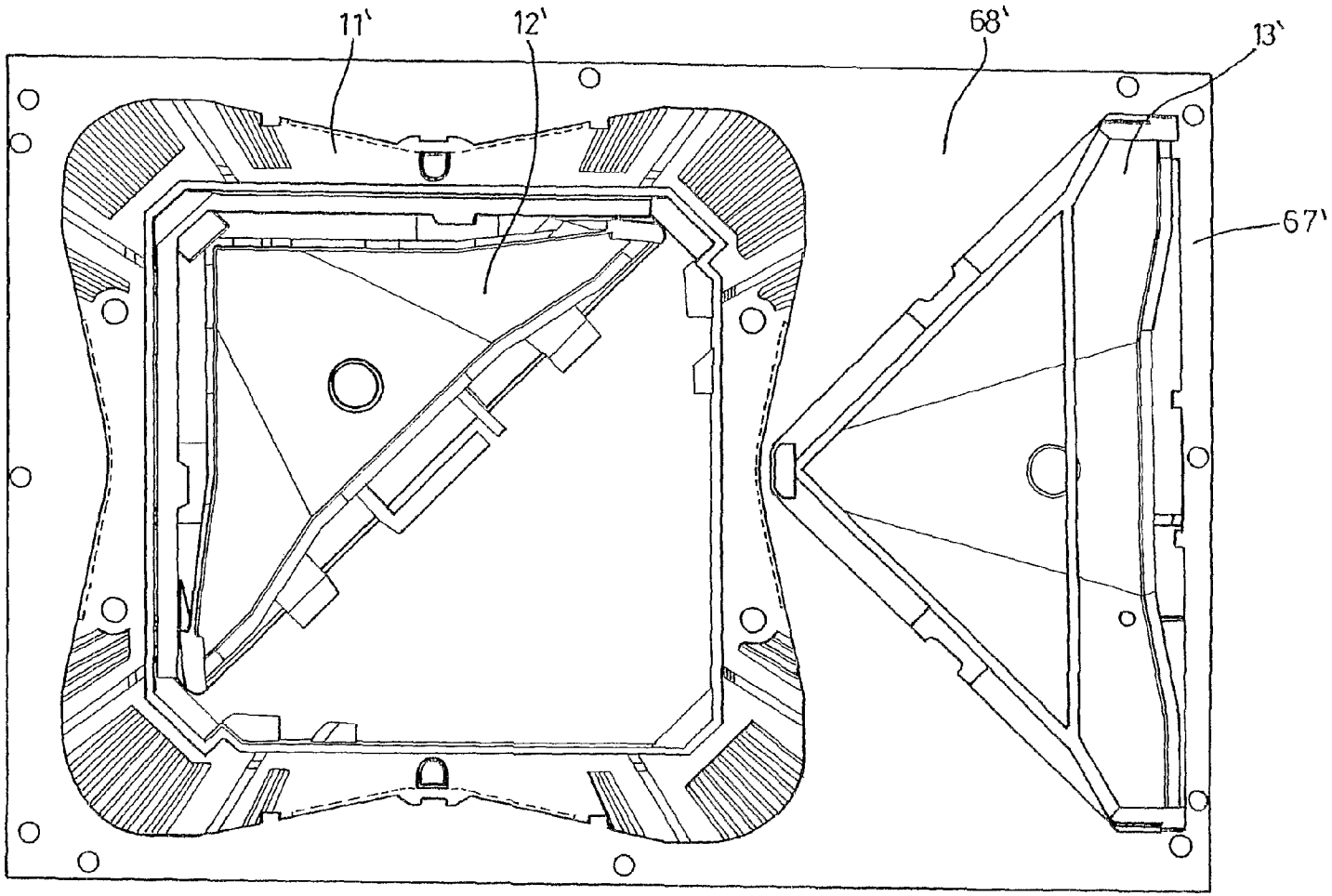
FIG. 17 shows the arrangements of the components of the FIG. 7 assembly during casting thereof in a moulding box.

FIG. 17 shows in schematic form a method of manufacturing the manhole assembly of the invention. FIG. 17 illustrates the principles of the method with reference to the second embodiment shown in FIGS. 7 to 16, but such principles are equally applicable to the first embodiment.

In FIG. 17 a moulding box 67' has formed therein a sand mould 68' the techniques for the manufacture of which are known in the art.

By reason of being smaller than second cover plate 13', whereby the dimensions of frame 11' in the vicinity of the region thereof that in use accommodates the second cover plate 13' are large enough to permit casting within the frame 11' of the first cover plate 12'.

This leaves sufficient space in the moulding box 67' externally of the frame 11' for casting of the second cover plate 13' alongside the frame 11' and first cover plate 12'.

As a consequence of this the three components of the manhole assembly are cast simultaneously and hence are all available at the same time to permit connection of the components together to form the assembly 10' ready for dispatch. This represents a significant saving in terms of manufacturing time and also in terms of storage space in a foundry, compared with the methods of manufacturing the prior art manhole assemblies.

Since the frames 11 and 11' described herein are generally square in shape, two right-angled isosceles triangular cover plates 12, 13 or 12', 13' efficiently close off the aperture defined by the wall 16/16'. It is however well known in the manhole assembly art for a manufacturer in addition to a generally square frame as shown also to provide a "double" version in which the shape of the upstanding wall 16/16' of the frame 11/11' is, when viewed in plan, a more elongate rectangle.

In particular the typical "double" manhole assembly includes a frame 11 that is, in essence, of the same width as a "single" (ie. generally square) frame but of double the length. Such a manhole aperture may readily be closed off by four of the isosceles right-angled triangular cover plates.

The principles of the invention are applicable to manhole assemblies of the "double" (elongate rectangular) type. The claims hereof embrace such arrangements within their scope.

Moreover, the invention is described herein with reference to embodiments in the form of manhole assemblies. Nonetheless the principles of the invention are applicable to other arrangements in which one or more pairs of cover plates are received in a frame bounding an aperture. Such arrangements include but are not limited to storm drains and gully grates. The invention embraces such assemblies within its scope.

The invention claimed is:

1. A manhole assembly comprising:

a frame and at least a pair of cover plates that are receivable in and disengageable from the frame to permit selective closing and opening of an aperture, the periphery of which is defined by the frame, the cover plates substantially occupying the aperture when received in the frame;

a first cover plate of the pair being smaller than a second cover plate of the pair;

the first cover plate being hingeable relative to the second cover plate, while the second cover plate is received in the frame, by a hinge system interconnecting the first and second cover plates so as to permit movement of the first cover plate relative to the second cover plate, from a closed position received in the frame to an open position in which a first part of the aperture is open, by a movement of the first cover plate from a first orientation via a second orientation to a third orientation relative to the second cover plate; and the second cover plate being removable from the frame, when the first cover plate is disengaged from the frame, to open a second part of the aperture, wherein the hinge system includes a tongue and a pocket, the tongue being receivable in the pocket, and the hinge system being formed so as to permit:

a. rotatable retention of the tongue relative to the pocket when the first cover plate occupies at least the first orientation relative to the second cover plate; and b. separation of the first cover plate from the second cover plate when the first cover plate occupies the second or third orientation relative to the second cover plate.

2. A manhole assembly according to claim 1, wherein the first and second cover plates of each pair in plan view are of right-angled triangular shapes.

3. A manhole assembly according to claim 2, wherein each right-angled triangular shape is of an isosceles triangle.

4. A manhole assembled according to claim 2, wherein in use of the assembly the hypotenuses of the triangular shapes are mutually juxtaposed along a line.

5. A manhole assembly according to claim 2, wherein the apices of the triangular shapes are truncated.

6. A manhole assembly according to claim 5, wherein the frame includes an upstanding wall that defines a recess for receiving the cover plates, the upstanding wall being truncated at locations corresponding to the truncated apices of the triangular plates when the truncated apices are received in the frame.

7. A manhole assembly according to claim 6, wherein the upstanding wall intersects each end of the line along which the hypotenuses of the triangular shapes are juxtaposed; and the upstanding wall includes, at least at one said intersection with the line, a stepped portion that accommodates the differing lengths of the hypotenuses of the respective cover plates.

8. A manhole assembly according to claim 1, wherein the first orientation corresponds to the relative orientation of the cover plates when both of the first and second cover plates are received in the frame.

9. A manhole assembly according to claim 1, wherein the first and second cover plates each include a structure that permits lifting of the respective cover plate.

10. A manhole assembly according to claim 9, wherein the lifting structure of at least the first cover plate is formed in an end wall of the cover plate so as to be obscured when the first cover plate is received in the frame.

11. A manhole assembly according to claim 1, wherein the tongue and the pocket are formed so as to cause retention of the first cover plate relative to the second cover plate when the first cover plate occupies the third orientation relative to the second cover plate.

12. A manhole assembly according to claim 11, wherein said first and third orientations of the first cover plate relative to the second cover plate correspond to extremes of movement of the first cover plate relative to the second cover plate when the second cover plate is received in the frame, and the second orientation corresponds to a position of the first cover plate, relative to the second cover plate, that is intermediate of the extremes.

13. A manhole assembly according to claim 11 or claim 12, wherein the tongue and the pocket each include a protuberance, the protuberances being mutually engageable when the first cover plate occupies the third orientation relative to the second cover plate so as to prevent removal of the tongue from the pocket to retain the first cover plate relative to the second cover plate.

14. A manhole assembly according to claim 1, wherein the pocket includes formed therein a recess, into which at least part of the tongue passes during movement of the first cover plate between the first and third orientations thereof relative to the second cover plate, the recess providing clearance for the tongue during such movement of the first cover plate.

15. A manhole assembly according to claim 1 including a lock for releasably locking the first cover plate in the first orientation relative to the second cover plate.

16. A manhole assembly according to claim 15, wherein the lock comprises:

a locking tongue secured on the in-use underside of the first cover plate; and a tab, with which the locking tongue is engageable, that lies on the frame and is obscured by the first cover plate when the latter is received in the frame, at least one of the locking tongue and the tab being resiliently deformably mounted and the locking tongue and the tab being so located as releasably to engage one another when the first cover plate is received in the frame.

17. A manhole assembly according to claim 15, wherein the lock includes:

a locking tongue secured on the in-use underside of the first cover plate; and a tab, with which the locking tongue is engageable, that lies on the second cover plate and is obscured by the first cover plate when the latter is received in the frame, at least one of the locking tongue and the tab being resiliently deformably mounted and the locking tongue and the tab being so located as releasably to engage one another when the first cover plate is received in the frame.

18. A manhole assembly according to claim 16 or a manhole assembly according to claim 17, wherein the locking tongue and/or the tab include mutually engageable surfaces that are, in use of the assembly, inclined relative to the vertical whereby on movement of the first cover plate towards its first orientation relative to the second cover plate the surfaces displace the locking tongue and/or the tab against the resilience of its mounting; and the locking tongue and the tab include locking surfaces that are engageable one with the other, following such displacement, to inhibit release of the locking tongue and the tab one from the other.

19. A manhole assembly according to claim 16 or a manhole assembly according to claim 17, wherein the frame and/or the first cover plate include formed therein one or more apertures or recesses for receiving a tool for prying the first cover plate from the frame against the resilience of the mounting of the locking tongue and/or the tab.

20. A manhole assembly according to claim 1, wherein one cover plate of the pair includes formed therein a lifting recess; and the other cover plate of the pair includes protruding therefrom a blanking member that closes off the lifting recess, so as to inhibit insertion of a lifting tool thereinto, when the first cover plate occupies its closed position while the second cover plate is received in the frame.

21. A manhole assembly according to claim 20, wherein the lifting recess is a through-going aperture that is elongate when viewed in plan.

22. A manhole assembly according to claim 20, wherein the lifting recess is formed in the second cover plate of the pair; and the blanking member protrudes from the first cover plate of the pair.

23. A manhole assembly according to claim 1, wherein the second cover plate is not removable from the frame when the first cover plate is received in the frame.

24. A manhole assembly according to claim 1, wherein:

the hinge system further includes a locking tongue and a locking surface; and the locking tongue is engaged with the locking surface in the first orientation so that the first cover plate is not removable from the second cover plate when the first cover plate is in the first orientation.

25. A manhole assembly according to claim 24, wherein the locking tongue disengages the locking surface in the second orientation so as to allow removal of the first cover plate from the second cover plate when the first cover plate is in the second orientation.

26. A manhole assemble according to either claim 24 or claim 25, wherein:

the first cover plate includes the tongue and the locking tongue; and the second cover plate includes the pocket and the locking surface.

* * * * *